US011538449B2

(12) United States Patent
Kobayashi et al.

(10) Patent No.: US 11,538,449 B2
(45) Date of Patent: Dec. 27, 2022

(54) ELECTRONIC PERCUSSION INSTRUMENT, STROKE DETECTION DEVICE, AND STROKE DETECTION METHOD

(71) Applicant: Roland Corporation, Shizuoka (JP)

(72) Inventors: Syota Kobayashi, Shizuoka (JP); Ryo Tanida, Shizuoka (JP)

(73) Assignee: Roland Corporation, Shizuoka (JP)

( * ) Notice: Subject to any disclaimer, the term of this patent is extended or adjusted under 35 U.S.C. 154(b) by 153 days.

(21) Appl. No.: 16/941,507

(22) Filed: Jul. 28, 2020

(65) Prior Publication Data

US 2021/0035542 A1 Feb. 4, 2021

(30) Foreign Application Priority Data

Aug. 1, 2019 (JP) ..... JP2019-142411

(51) Int. Cl.

*G10H 3/14* (2006.01)
*G10H 1/34* (2006.01)
*G10H 1/00* (2006.01)

(52) U.S. Cl.

CPC ..... *G10H 3/146* (2013.01); *G10H 1/0008* (2013.01); *G10H 1/34* (2013.01); *G10H 2220/155* (2013.01); *G10H 2220/461* (2013.01)

(58) Field of Classification Search

CPC ..... G10H 3/146; G10H 1/0008; G10H 1/34; G10H 2220/155; G10H 2220/461

See application file for complete search history.

(56) References Cited

U.S. PATENT DOCUMENTS

| | | | | |
|---|---|---|---|---|
| 6,632,989 | B2 | 10/2003 | Yoshino et al. | |
| 6,881,885 | B2 | 4/2005 | Yoshino et al. | |
| 7,294,778 | B2 * | 11/2007 | Susami | G10H 3/146 84/723 |
| 7,473,834 | B2 * | 1/2009 | Yoshino | G10H 1/32 84/742 |
| 2002/0059861 | A1 * | 5/2002 | Yoshino | G10D 13/02 84/402 |
| 2004/0016339 | A1 * | 1/2004 | Yoshino | G10D 13/06 84/723 |
| 2016/0196811 | A1 | 7/2016 | Shen | |

(Continued)

FOREIGN PATENT DOCUMENTS

| | | |
|---|---|---|
| CN | 202258288 | 5/2012 |
| JP | 2002062872 | 2/2002 |

(Continued)

*Primary Examiner* — Jianchun Qin
(74) *Attorney, Agent, or Firm* — JCIPRNET

(57) ABSTRACT

An electronic percussion instrument, a stroke detection device, and a stroke detection method which can improve stroke detection accuracy are provided. A thickness dimension (L2) of an upper cover part (5*b*1) is approximately constant from the inner circumferential side to the outer circumferential side in a region facing the upper surface of an outer circumferential part (4*b*3) of the frame bow part (4*b*) (a concave part formed according to a level difference between a bent part (4*b*2) and the outer circumferential part (4*b*3)). Accordingly, the entire upper cover part (5*b*1) is easily deformed such that it is bent when struck, and thus a protrusion part (5*b*3) can be securely pressed to an edge sensor (7*b*) according to deformation of the upper cover part (5*b*1). Therefore, the accuracy of detection of a stroke applied to the upper cover part (5*b*1) can be improved.

8 Claims, 10 Drawing Sheets

(a)

(b)

(56) References Cited

U.S. PATENT DOCUMENTS

| | | | |
|---|---|---|---|
| 2018/0204557 | A1 | 7/2018 | Steinhauser |
| 2018/0277070 | A1 | 9/2018 | Mori |

FOREIGN PATENT DOCUMENTS

| | | |
|---|---|---|
| JP | 2002207481 | 7/2002 |
| JP | 2009145558 | 7/2009 |
| JP | 2009145559 | 7/2009 |
| JP | 2009145561 | 7/2009 |
| JP | 2009156886 | 7/2009 |
| JP | 2015028521 | 2/2015 |

* cited by examiner (a)

(b)

(a)

(b)

(a)

(b)

(a)

(b)

ELECTRONIC PERCUSSION INSTRUMENT, STROKE DETECTION DEVICE, AND STROKE DETECTION METHOD

CROSS-REFERENCE TO RELATED APPLICATION

This application claims the priority benefit of Japan Patent Application No. 2019-142411, filed on Aug. 1, 2019. The entirety of the above-mentioned patent application is hereby incorporated by reference herein and made a part of this specification.

BACKGROUND

Technical Field

The present disclosure relates to an electronic percussion instrument, a stroke detection device, and a stroke detection method, and particularly, to an electronic percussion instrument, a stroke detection device, and a stroke detection method which can improve stroke detection accuracy.

Description of Related Art

An electronic cymbal including a disk-shaped frame and a cover that covers a range from the upper surface to the outer edge side of the lower surface of the frame is known. In this type of electronic cymbal, a technique of detecting a stroke applied to the outer edge part (edge) of the electronic cymbal using a sensor provided between the edge of the upper surface of the frame and the cover is known.

For example, Patent Document 1 discloses a technique for forming a protrusion part (protrusion for pressing) projecting toward a sensor on the lower surface of a cover and forming a gap between the protrusion part and the sensor. According to this technique, when the outer edge part of the cover is struck, the stroke is detected in such a manner that the protrusion part is pressed to the sensor according to elastic deformation of the cover. In addition, in this technique, a deviation of a relative position with respect to the sensor and the protrusion part in a radial direction is prevented and adverse influence on the sensitivity of the sensor is curbed by forming a concave part and a convex part which can be engaged with each other in the frame and the cover.

Patent Documents

[Patent Document 1] Japanese Patent Laid-Open No. 2009-145559 (for example, paragraphs 0047 to 0049 and FIG. 9)

However, in the above-described conventional technique, elastic deformation toward the inner circumferential side of the cover (a part positioned on the side of the lower surface of the frame) may be obstructed due to connection of the concave part and the convex part when the outer edge part of the cover is struck because the concave part and the convex part are formed on the side of the lower surface of the frame. Accordingly, there is a problem that the protrusion part is not sufficiently pressed to the sensor and thus stroke detection accuracy decreases.

The present disclosure devised to solve the aforementioned problem provides an electronic percussion instrument, a stroke detection device, and a stroke detection method which can improve stroke detection accuracy.

SUMMARY

There is provided an electronic percussion instrument of an embodiment of the present disclosure, including: a disk-shaped frame in which a concave part recessed toward a lower surface side is formed at an outer edge part of an upper surface; a sensor disposed in the concave part of the frame; and a cover covering the frame in a state in which a space that can receive the sensor is formed, wherein the cover includes a protrusion part formed in a protrusion shape protruding from a lower surface of the cover to the sensor and disposed having a gap between the protrusion part and the sensor, and a thickness dimension of the cover is approximately constant in a region facing the concave part, in which the protrusion part is not formed.

Further, an electronic percussion instrument of an embodiment of the present disclosure includes: a disk-shaped frame in which a concave part recessed toward a lower surface side is formed at an outer edge part of an upper surface; a sensor disposed in the concave part of the frame; and a cover covering the frame in a state in which a space that can receive the sensor is formed, wherein the cover includes a protrusion part formed in a protrusion shape protruding from a lower surface of the cover to the sensor and disposed having a gap between the protrusion part and the sensor, and a thickness dimension of the cover is reduced in a part of the cover in a region facing the concave part, in which the protrusion part is not formed.

A stroke detection device of an embodiment of the present disclosure includes: a main body member in which a concave part recessed toward a lower surface side is formed at an outer edge part of an upper surface; a sensor disposed in the concave part of the main body member; and a cover covering the main body member in a state in which a space that can receive the sensor is formed, wherein the cover includes a protrusion part formed in a protrusion shape protruding from the lower surface of the cover to the sensor and disposed having a gap between the protrusion part and the sensor, and a thickness dimension of the cover is reduced in a part of the cover in a region facing the concave part, in which the protrusion part is not formed.

A stroke detection method of an embodiment of the present disclosure is a stroke detection method in a stroke detection device including: a main body member in which a concave part recessed toward a lower surface side is formed at an outer edge part of an upper surface; a sensor disposed in the concave part of the main body member; and a cover covering the main body member in a state in which a space that can receive the sensor is formed, wherein the cover includes a protrusion part formed in a protrusion shape protruding from the lower surface of the cover to the sensor and disposed having a gap between the protrusion part and the sensor, and a thickness dimension of the cover is reduced in a part of the cover in a region facing the concave part, in which the protrusion part is not formed, the stroke detection method including deforming the cover such that the entire cover is bent in the region facing the concave part when an outer edge part of the cover is struck, and detecting the stroke on the basis of contact between the protrusion part and the sensor according to the deformation.

Figure 3:
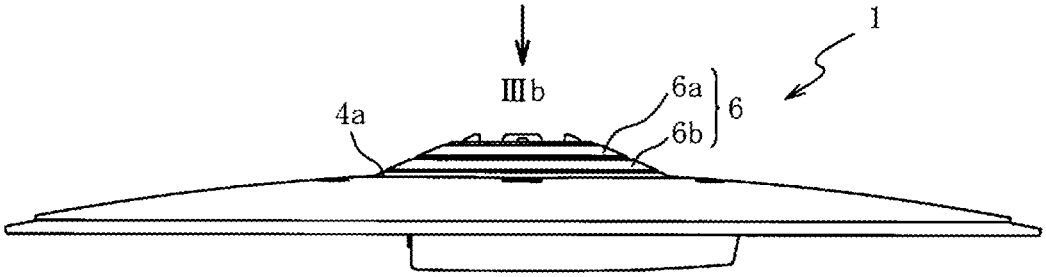
Figure 3:
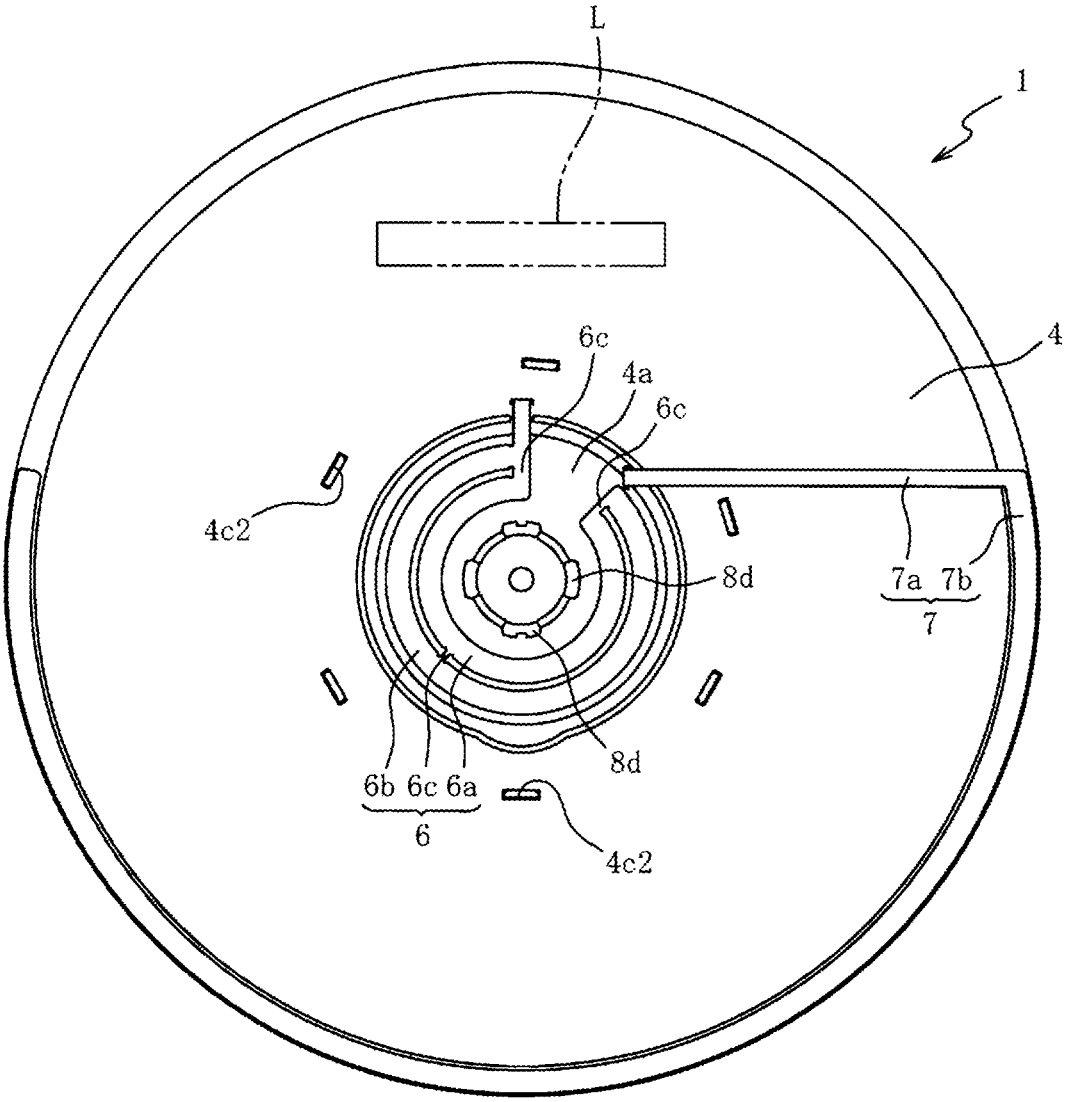

(a) of FIG. 3 is a side view of the electronic cymbal without a cover and (b) of FIG. 3 is a top view of the electronic cymbal without a cover.

Figure 2:
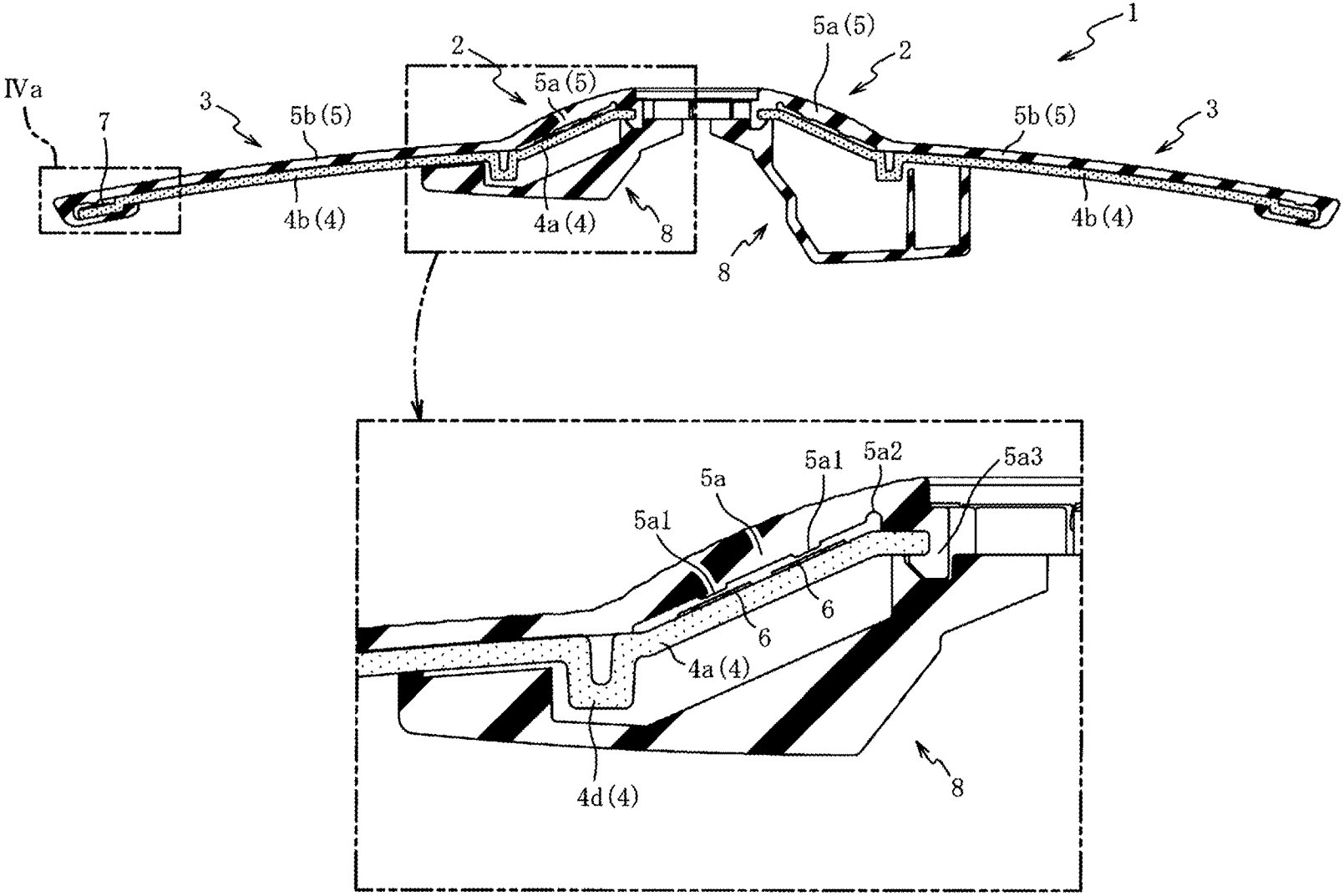
FIG. 2 is a cross-sectional view of the electronic cymbal taken along line II-II of FIG. 1.
Figure 4:
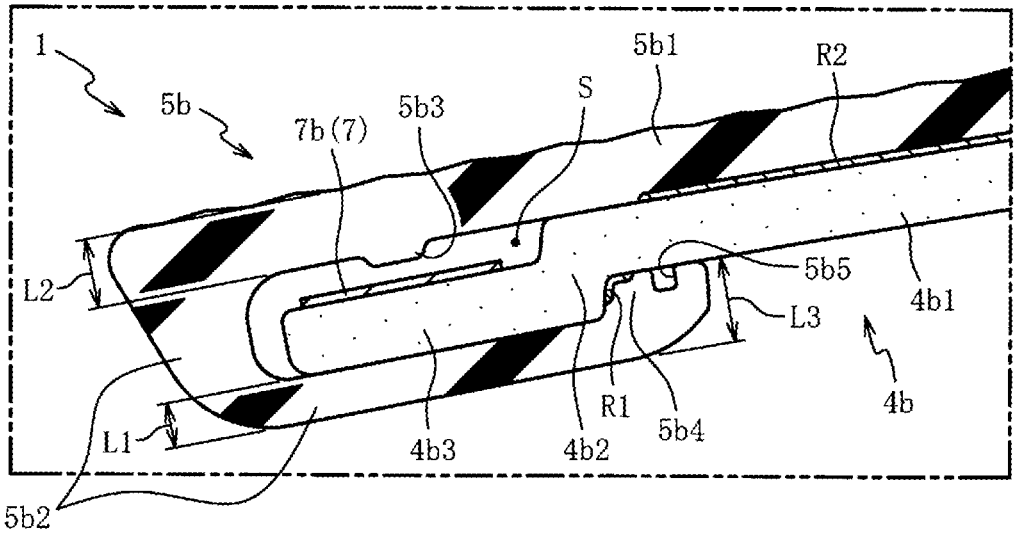
Figure 4:
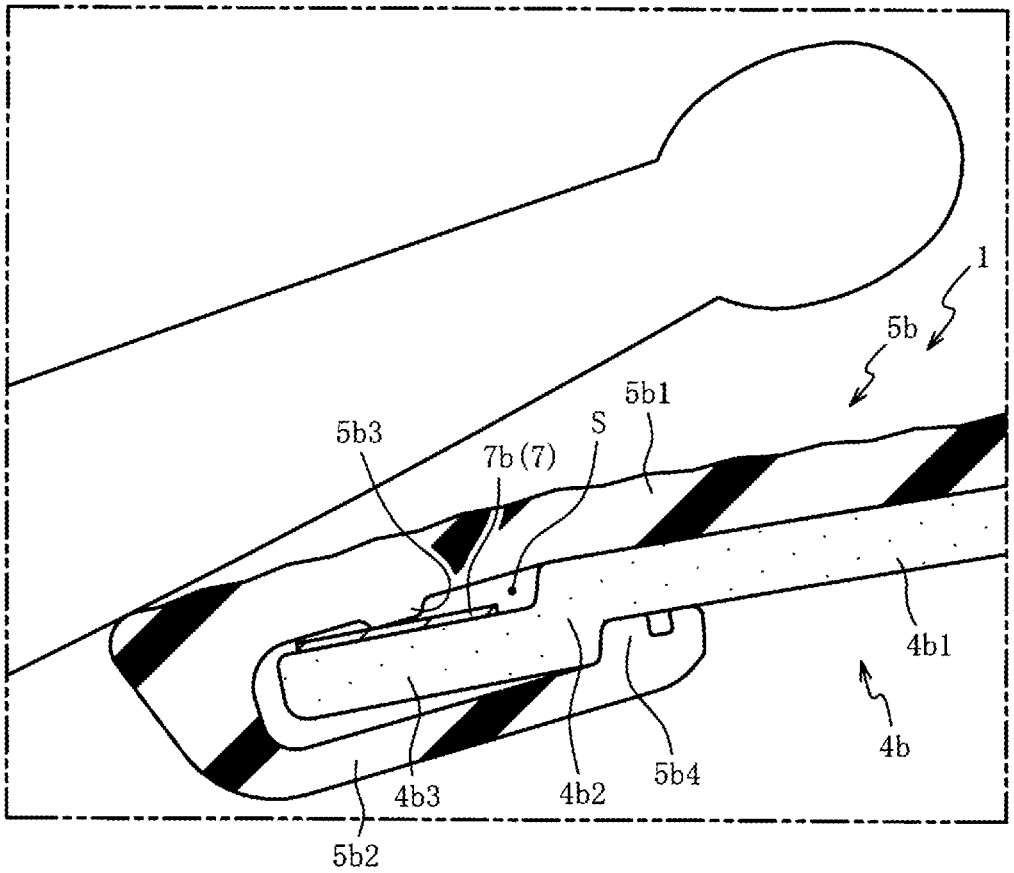

(a) of FIG. 4 is a partially enlarged cross-sectional view of a part IVa of the electronic cymbal in FIG. 2 and (b) of FIG. 4 is a partially enlarged cross-sectional view of the electronic cymbal showing a state in which the electronic cymbal has been struck by a stick in the state of (a) of FIG. 4.

Figure 5:
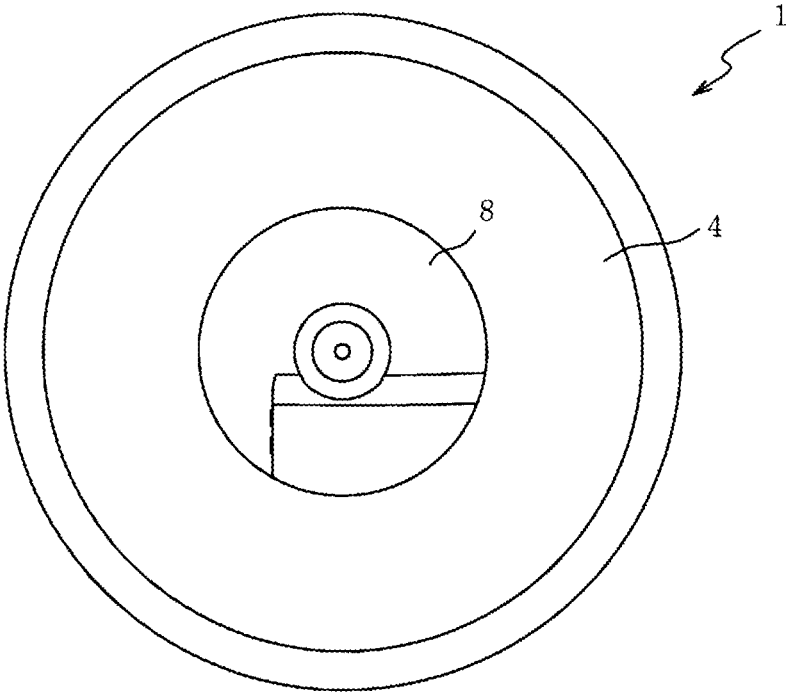
Figure 5:
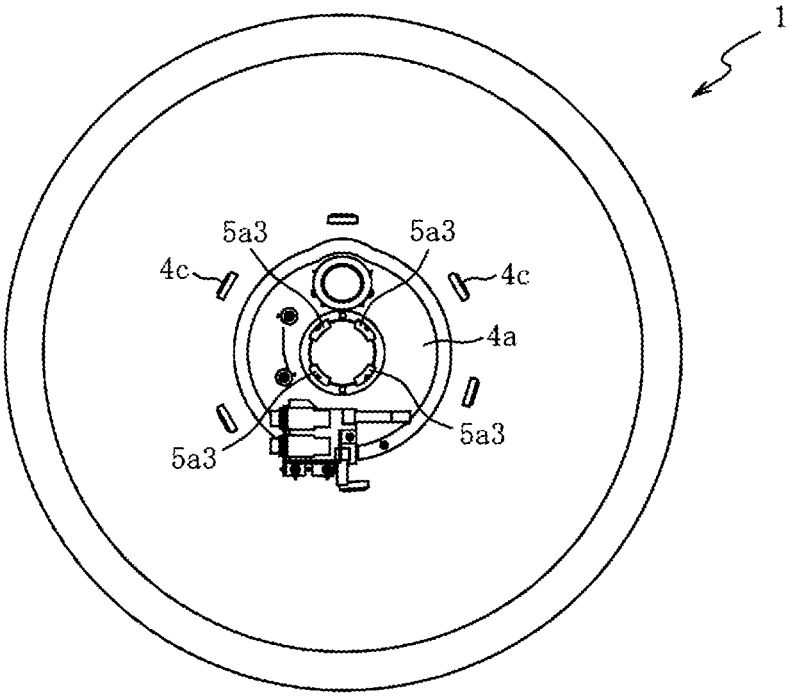

(a) of FIG. 5 is a bottom view of the electronic cymbal and (b) of FIG. 5 is a bottom view of the electronic cymbal when a case has been removed.

Figure 1:
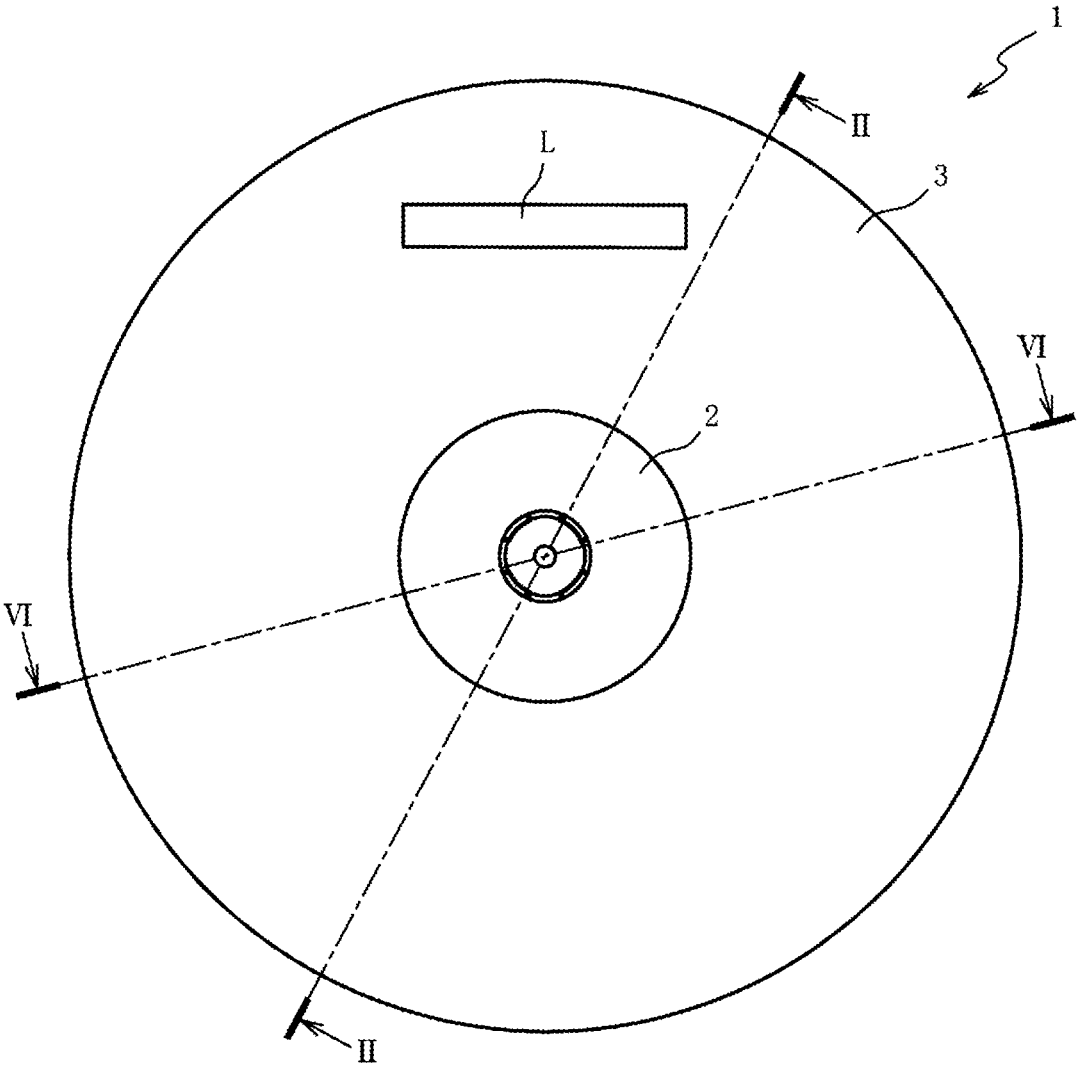
FIG. 1 is a top view of an electronic cymbal of an embodiment.
Figure 6:
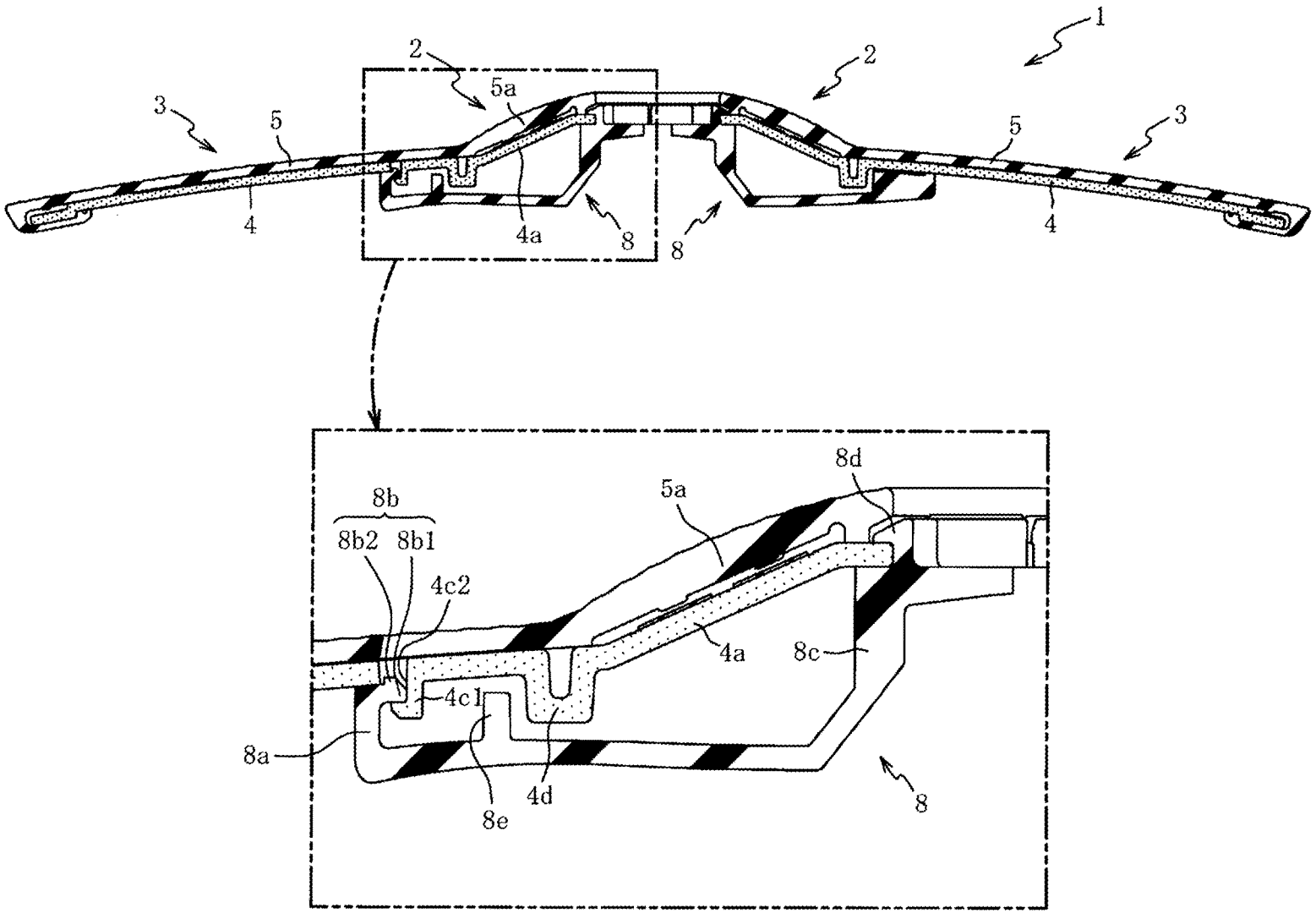

FIG. 6 is a cross-sectional view of the electronic cymbal taken along line VI-VI of FIG. 1.

Figure 7:
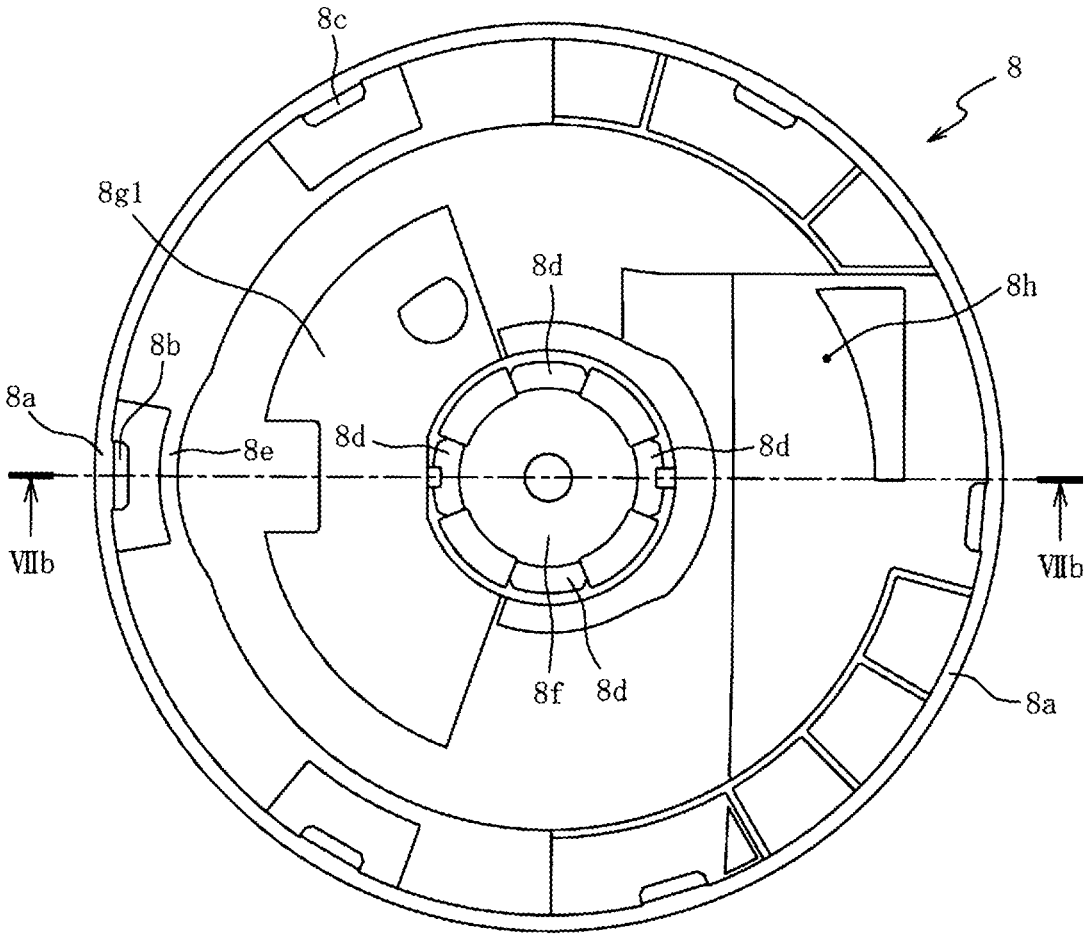
Figure 7:
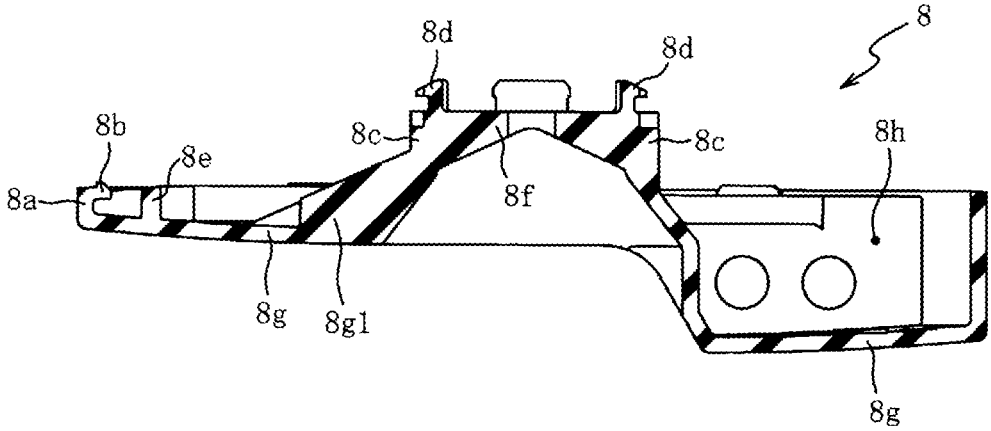

(a) of FIG. 7 is a top view of a case and (b) of FIG. 7 is a cross-sectional view of the case taken along line VIIb-VIIb of (a) of FIG. 7.

Figure 8:
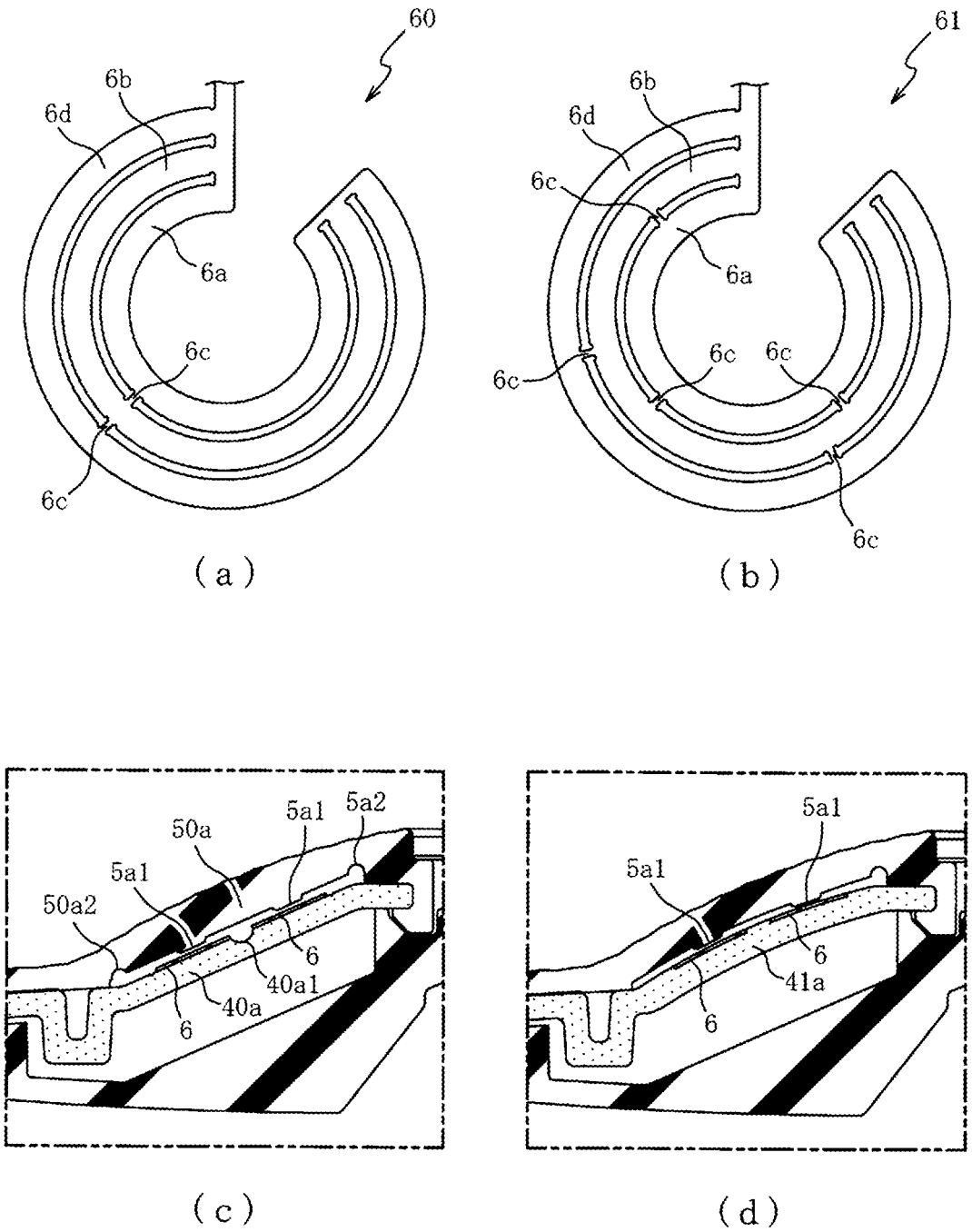

(a) of FIG. 8 is a top view of a bell part sensor in a modified example, (b) of FIG. 8 is a top view of a bell part sensor in another modified example, (c) of FIG. 8 is a cross-sectional view of an electronic cymbal showing a frame in a modified example, and (d) of FIG. 8 is a cross-sectional view of an electronic cymbal showing a frame in another modified example.

Figure 9:
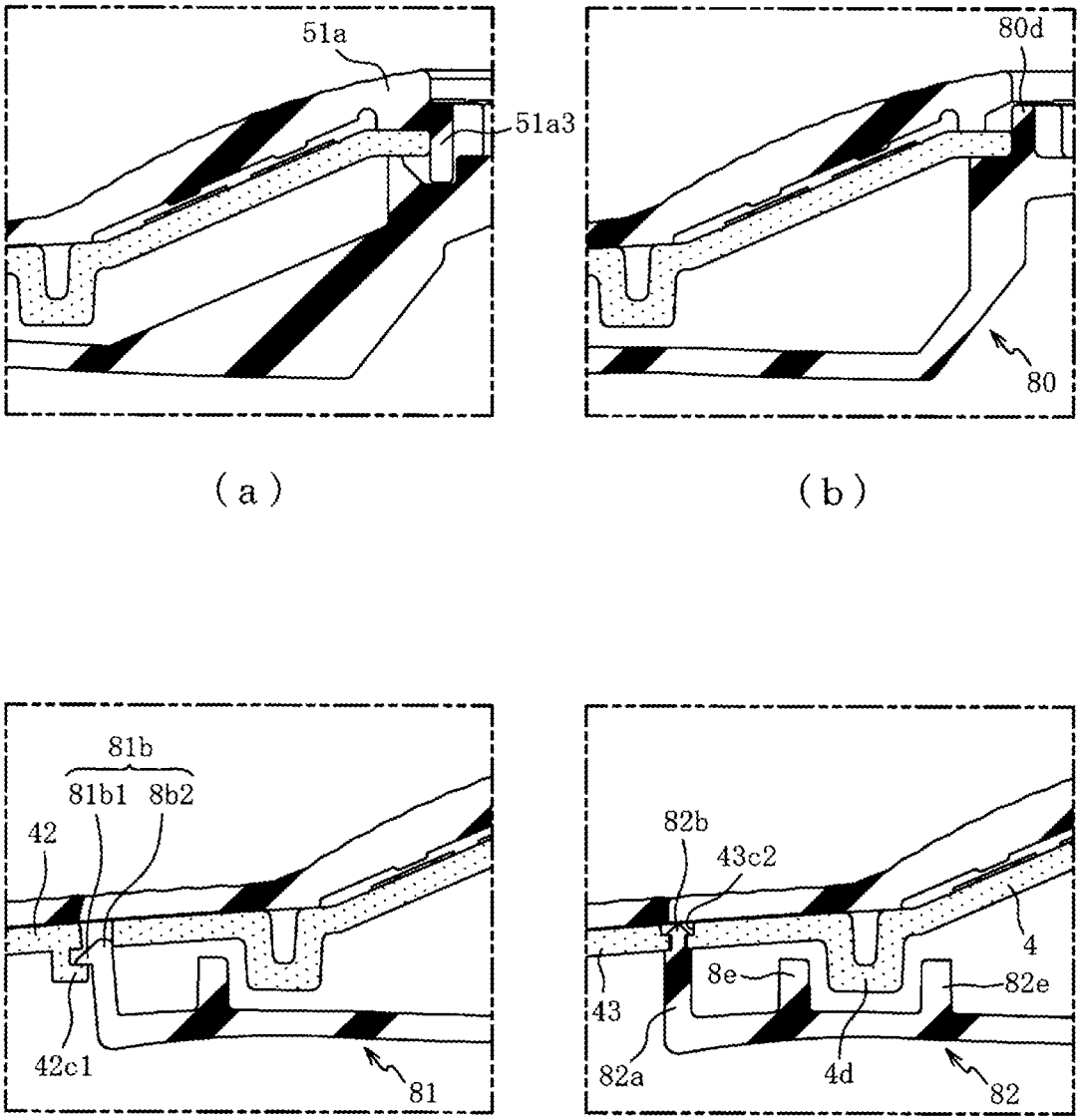

(a) of FIG. 9 is a cross-sectional view of an electronic cymbal showing an engagement part in a modified example, (b) of FIG. 9 is a cross-sectional view of the electronic cymbal showing an enclosing part in the modified example, (c) of FIG. 9 is a cross-sectional view of the electronic cymbal showing a supporting part and a hooking part in the modified example, and (d) of FIG. 9 is a cross-sectional view of an electronic cymbal showing a hooking part and a supporting pillar in another modified example.

Figure 10:
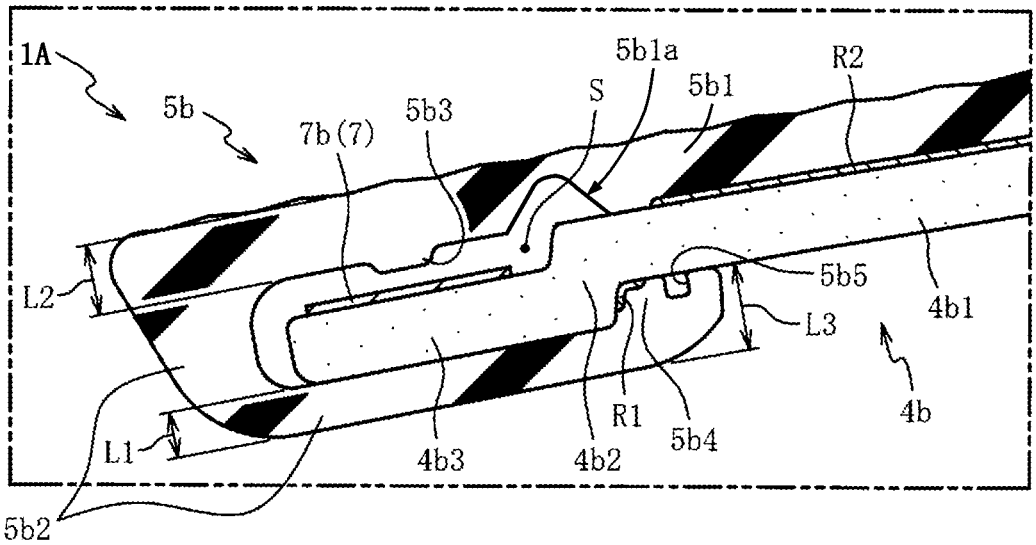

FIG. 10 is a partially enlarged cross-sectional view of an electronic cymbal of an embodiment.

DESCRIPTION OF THE EMBODIMENTS

Hereinafter, a preferred embodiment will be described with reference to the attached drawings. FIG. 1 is a top view of an electronic cymbal 1 of an embodiment. The electronic cymbal 1 is an electronic percussion instrument imitating a cymbal and includes a bell part 2 provided at the center thereof and having a circular shape in a top view, and a bow part 3 provided outside the bell part 2. A logo L representing a manufacturer name, a product name, and the like is formed in the bow part 3, and a player plays the electronic cymbal by striking a part near the opposite side of the logo L based on the bell part 2 on the upper surface of the bow part 3.

When the player strikes the bell part 2 using a stick or the like, the stroke applied to the bell part 2 is detected by a bell part sensor 6 which will be described later in FIG. 2. When the bow part 3 is struck, the stroke applied to the upper surface of the bow part 3 is detected by a stroke sensor (not shown). In addition, when the outer edge (edge) part of the bow part 3 is struck, the stroke is detected by an edge part sensor 7 which will be described later in FIG. 4. That is, these sensors (fitting structures of the sensors which will be described later) constitute a stroke detection device in the electronic percussion instrument. A stroke detected by the bell part sensor 6, the stroke sensor, and the edge part sensor 7 is converted into an electrical signal and input to a sound source device that is not shown to generate music according to stroke applied to the bell part 2 and the bow part 3.

A structure of the electronic cymbal 1 will be described with reference to FIGS. 2 to 7. First, a fitting structure of the bell part sensor 6 will be described. FIG. 2 is a cross-sectional view of the electronic cymbal 1 taken along line II-II of FIG. 1. As shown in FIG. 2, the electronic cymbal 1 includes a frame 4 made of reinforced plastic which forms a frame, a cover 5, the bell part sensor 6 and the edge part sensor 7 provided on the upper surface of the frame 4, and a case 8 made of synthetic rubber which is provided on the lower surface of the frame 4 and protects electronic parts of the electronic cymbal 1.

A frame bell part 4*a* is formed at a position corresponding to the bell part 2 in the frame 4 and a frame bow part 4*b* is formed at a position corresponding to the bow part 3 in the frame 4. The frame bow part 4*b* is a part forming the outer circumferential side of the frame bell part 4*a* in the frame 4 and is connected to the outer edge of the frame bell part 4*a* through a restriction part 4*d* (refer to an enlarged part of FIG. 2) which will be described later. The frame bell part 4*a* is formed in a conical shape in which the side thereof tapers upward, and the bell part sensor 6 that detects stroke of the bell part 2 is attached to the side of the frame bell part 4*a* using a double-sided tape.

The bell part sensor 6 is formed in a sheet shape by coating conductive paste on films made of polyethylene terephthalate (PET) and vertically laminating the coated films such that the conductive paste layers face each other. When the bell part sensor 6 is pressed according to a stroke or the like and thus the upper and lower conductive paste layers come into contact with each other, an electrical signal is output from the bell part sensor 6.

Since the side of the frame bell part 4*a* is formed in a conical shape, the shape of the side in the cross section of the frame bell part 4*a* becomes a straight-line shape. The bell part sensor 6 and the frame bell part 4*a* can be caused to press against each other in the radial direction by attaching the sheet-shaped bell part sensor 6 to the frame bell part 4*a*.

The cover 5 is a member made of synthetic rubber which covers the upper part of the frame 4 and forms a striking surface of the electronic cymbal 1. The cover 5 is attached to the frame 4 using a double-sided tape. Specifically, a part corresponding to the bow part 3 (refer to FIG. 1) in the upper surface of the frame 4 is attached to a position corresponding to the bow part 3 (refer to FIG. 1) in the cover 5 using a double-sided tape.

A cover bell part 5*a* covering the frame bell part 4*a* and the bell part sensor 6 is formed at a position corresponding to the bell part 2 in the cover 5, and a cover bow part 5*b* covering the frame bow part 4*b* and the edge part sensor 7 is formed at a position corresponding to the bow part 3 in the cover 5. The cover bell part 5*a* is formed in a hemispherical shape (bowl shape) in which the surface thereof, that is, the surface struck by a stick or the like, projects upward. Accordingly, the surface of the cover bell part 5*a*, that is, the surface of the bell part 2 can be a shape fitted to the shape of the bell part of a real cymbal.

A protrusion part 5*a*1 in a protrusion shape is formed on the reverse side of the cover bell part 5*a*, that is, the surface facing the frame bell part 4*a* and the bell part sensor 6, which is a position facing the bell part sensor 6. The surface facing the bell part sensor 6 (opposing surface) in the protrusion part 5*a*1 is formed in a conical shape such that it corresponds to the shape of the frame bell part 4*a* at the position where the bell part sensor 6 is installed. In addition, the protrusion part 5*a*1 is formed such that the opposing surface of the protrusion part 5*a*1 faces and is parallel to the bell part sensor 6. Further, the protrusion part 5*a*1 is formed such that a gap is provided between the opposing surface of the protrusion part 5*a*1 and the upper surface of the bell part sensor 6 and the size of the gap is set to 0.3 mm to 0.8 mm.

When the cover bell part 5*a* is struck, the cover bell part 5*a* is bent and thus the gap between the protrusion part 5*a*1 and the bell part sensor 6 is eliminated. Accordingly, the bell part sensor 6 is pressed against the protrusion part 5*a*1 and thus the stroke is transmitted to the bell part sensor 6. Here, since the opposing surface of the protrusion part 5*a*1 is formed such that it corresponds to the shape of the frame bell part 4*a* at the position where the bell part sensor 6 is installed and the opposing surface of the protrusion part 5*a*1 and the bell part sensor 6 are formed such that they face each other and are parallel to each other, the bell part sensor 6 is pressed by parallel surfaces of the protrusion part 5*a*1 and the frame bell part 4*a*. Accordingly, the upper and lower conductive paste layers of the bell part sensor 6 are pressed downward and upward parallel to each other, and thus stroke applied to the cover bell part 5*a* can be appropriately transmitted to the bell part sensor 6.

Since the gap is formed between the opposing surface of the protrusion part 5*a*1 and the bell part sensor 6, the protrusion part 5*a*1 is prevented from coming into contact with the bell part sensor 6 when a part other than the cover bell part 5*a*, for example, the bow part 3 is struck. Accordingly, erroneous detection of the bell part sensor 6 when a part other than the cover bell part 5*a* is struck can be prevented.

Further, the gap between the opposing surface of the protrusion part 5*a*1 and the bell part sensor 6 is set to 0.3 mm to 0.8 mm. Accordingly, the protrusion part 5*a*1 can be pressed to the bell part sensor 6 even when a stroke applied to the cover bell part 5*a* is weak (i.e., the strength of a stroke is low), and thus stroke sensitivity for a weak stroke can be improved.

In the cover bell part 5*a*, a U-shaped recess 5*a*2 in a cross-sectional view is formed at a position on a circumferential side inside the protrusion part 5*a*1 on the inner circumferential side. The recess 5*a*2 is deformed according to a stroke applied to the cover bell part 5*a* and thus bending of the cover bell part 5*a* can be increased. Accordingly, since bending of the cover bell part 5*a* increases even when a stroke applied to the cover bell part 5*a* is weak, the stroke can be appropriately transmitted to the bell part sensor 6.

In addition, the cover bell part 5*a* is formed such that the thickness of a part in which the thickest protrusion part 5*a*1 is formed is less than twice the thickness of a part in which the thinnest recess 5*a*2 is formed. Accordingly, thickness increase in the cover bell part 5*a* is curbed, and thus elastic deformation of the cover bell part 5*a* with respect to a stroke applied to the cover bell part 5*a* can be suppressed. Therefore, a feeling of a stroke (stroke feeling) applied to the cover bell part 5*a* can be made to be hard as in a real cymbal.

An engagement part 5*a*3 that engages the cover 5 with the frame 4 by hooking the inner circumferential side of the frame bell part 4*a* is formed on the inner circumferential side of the cover bell part 5*a*. The engagement part 5*a*3 is formed at four places on the inner circumferential side of the cover bell part 5*a* (not shown) and is formed in a shape in which the engagement part 5*a*3 comes into contact with the upper surface, lower surface and side of the frame bell part 4*a* when the engagement part 5*a*3 is hooked on the inner circumferential side of the frame bell part 4*a*.

As described above, the part corresponding to the bow part 3 (refer to FIG. 1) on the upper surface of the frame 4 is attached to the position corresponding to the bow part 3 in the cover 5 using a double-sided tape. Here, the bell part sensor 6 is disposed on the frame bell part 4*a* first, and then the engagement part 5*a*3 is hooked on the inner circumferential side of the frame bell part 4*a* and position adjustment is performed such that the protrusion part 5*a*1 is placed on the bell part sensor 6.

Thereafter, the parts corresponding to the bow part 3 in the frame 4 and the cover 5 are sequentially attached in a direction from the inner circumferential side to the outer circumferential side of the cover 5. Here, since the cover 5 is engaged with the inner circumferential side of the frame bell part 4*a* according to the engagement part 5*a*3, movement of the cover 5 in the outer circumferential direction is suppressed. Accordingly, it is possible to attach the frame 4 and the cover 5 to each other while maintaining a positional relationship between the protrusion part 5*a*1 and the bell part sensor 6.

Next, the shapes of the bell part sensor 6 and the edge part sensor 7 will be described with reference to FIG. 3. (a) of FIG. 3 is a side view of the electronic cymbal 1 without the cover 5 and (b) of FIG. 3 is a top view of the electronic cymbal 1 without the cover 5. Meanwhile, in (a) of FIG. 3, illustration of the edge part sensor 7 (refer to (b) of FIG. 3) is omitted for simplification of the figure. As shown in (a) of FIG. 3, the sheet-shaped bell part sensor 6 is deformed into a conical shape and attached to the frame bell part 4*a* such that it corresponds to the shape of the frame bell part 4*a* with the side in the conical shape.

As shown in (b) of FIG. 3, the bell part sensor 6 is formed in an arc shape in a top view. The bell part sensor 6 is divided into two parts in the radial direction and, specifically, has an inner circumferential sensor 6*a* forming the inner circumferential side of the bell part sensor 6 and an outer circumferential sensor 6*b* forming the outer circumferential side. The width of the inner circumferential sensor 6*a* is approximately the same as the width of the outer circumferential sensor 6*b* in the radial direction. Meanwhile, "approximately the same" means that variation in manufacturing processes, materials and measurement is permitted. Specifically, "approximately the same" or "approximately constant" is defined as a range of ±10% and the same applies to the following description.

By dividing the bell part sensor 6 into the inner circumferential sensor 6*a* and the outer circumferential sensor 6*b*, the widths of the sensors 6*a* and 6*b* in the radial direction are reduced. As described above, although the bell part sensor 6 is bent corresponding to the shape (conical shape) of the side of the frame bell part 4*a* and attached, amounts of deformation of the inner circumferential sensor 6*a* and the outer circumferential sensor 6*b* due to bending are less than those in a case in which the bell part sensor 6 is formed as a single sensor. Accordingly, a repulsive force (restoring force) of the bent inner circumferential sensor 6*a* and outer circumferential sensor 6*b* to return to the initial sheet shape decreases to be less than that in a case in which the bell part sensor 6 is formed as a single sensor.

Accordingly, separation of the inner circumferential sensor 6*a* and the outer circumferential sensor 6*b* attached to the frame bell part 4*a* from the frame bell part 4*a* can be suppressed. Particularly, when the bell part 2 is struck or a temperature or humidity has been considerably changed due to an environmental test and the like, separation of the inner circumferential sensor 6*a* and the outer circumferential sensor 6*b* can be suppressed. In addition, since the amounts of deformation when the inner circumferential sensor 6*a* and the outer circumferential sensor 6*b* are bent decrease, separation of upper and lower films coated with the conductive paste on the inner circumferential sensor 6*a* and the outer circumferential sensor 6*b* can also be suppressed.

Furthermore, as shown in (b) of FIG. 3, the bell part sensor 6 is formed in an arc shape (C shape) with a part cut away in a top view, and the cut away part in the bell part sensor 6 is disposed in the frame bell part 4*a* such that the cut part is on the side of the logo L. This is because, when a player strongly strikes the bow part 3 (refer to FIG. 1) on the side opposite to the logo L based on the bell part 2, the electronic cymbal 1 moves up and down considerably as a rebound and a pillar (not shown) provided at the center of the bell part 2 comes into contact with the logo L side in the bell part 2. Accordingly, it is possible to curb erroneous detection of contact of the pillar with the bell part 2 as a strike applied to the bell part 2 when the bell part sensor 6 is not formed on the side on which the logo L is provided in the frame bell part 4*a*.

A connecting part 6*c* that connects the outer circumferential side of the inner circumferential sensor 6*a* and the inner circumferential side of the outer circumferential sensor 6*b* is provided in the bell part sensor 6. In the present embodiment, the connecting part 6*c* is provided at three places: both ends of the inner circumferential sensor 6*a* and the outer circumferential sensor 6*b* in the circumferential direction, and approximately a midpoint in the inner circumferential sensor 6*a* and the outer circumferential sensor 6*b* in the circumferential direction.

A positional relationship between the inner circumferential sensor 6*a* and the outer circumferential sensor 6*b* is maintained by connecting the outer circumferential side of the inner circumferential sensor 6*a* and the inner circumferential side of the outer circumferential sensor 6*b* through the connecting part 6*c*. Accordingly, it is possible to improve workability in installation of the bell part sensor 6 and positioning accuracy and suppress displacement of the inner circumferential sensor 6*a* and the outer circumferential sensor 6*b* in the circumferential direction at the time of a stroke. In addition, the connecting part 6*c* is disposed at three places in the circumferential direction of the inner circumferential sensor 6*a* and the outer circumferential sensor 6*b* at appropriately equal intervals. Accordingly, displacement of the inner circumferential sensor 6*a* and the outer circumferential sensor 6*b* in the circumferential direction can be more suitably suppressed.

As shown in (b) of FIG. 3, the edge part sensor 7 includes a connecting part 7*a* extending from the frame bell part 4*a* to the outer circumferential side, and an edge sensor 7*b* connected to the outer circumferential end of the connecting part 7*a*. The edge sensor 7*b* is formed in an arc shape (C shape) with a part cut away in a top view and attached to the outer edge part of the frame 4 in a posture in which the cut away part faces the logo L. Accordingly, a stroke applied to the outer edge (edge) part of the electronic cymbal 1 is detected by the edge sensor 7*b*. Meanwhile, the sensor structure of the edge sensor 7*b* has the same configuration as the aforementioned bell part sensor 6. Accordingly, when the edge sensor 7*b* is pressed by a stroke or the like and thus the upper and lower conductive paste layers come into contact with each other, an electrical signal is output from the edge part sensor 7.

Next, a fitting structure of the edge part sensor 7 and a stroke detection method will be described with reference to FIG. 4. (a) of FIG. 4 is a partially enlarged cross-sectional view of a part IVa of the electronic cymbal 1 in FIG. 2 and (b) of FIG. 4 is a partially enlarged cross-sectional view of the electronic cymbal 1 showing a state in which the electronic cymbal 1 has been struck by a stick in the state of (a) of FIG. 4. Meanwhile, FIG. 4 illustrates only the cross section of the electronic cymbal 1 for simplification of the figures. Further, joint regions R1 and R2 of the frame bow part 4*b* and the cover bow part 5*b* are exaggerated and schematically illustrated in (a) of FIG. 4 and illustration of such joint regions R1 and R2 is omitted in (b) of FIG. 4.

The frame bow part 4*b* includes a main body part 4*b*1 that is gently inclined downward from the outer edge of the frame bell part 4*a* (refer to FIG. 2) toward the outer circumferential side (outer side in the radial direction), a bent part 4*b*2 that is bent downward from the outer edge of the main body part 4*b*1, and an outer circumferential part 4*b*3 projecting from the side of the lower end of the bent part 4*b*2 toward the outer circumferential side and is formed in a disk shape. That is, the main body part 4*b*1, the bent part 4*b*2, and the outer circumferential part 4*b*3 constituting the frame bow part 4*b* are continuously formed in a circumferential direction.

The main body part 4*b*1 is a part forming a frame of a main body part of the bow part 3 (refer to FIG. 2), and the outer circumferential part 4*b*3 is a part forming a frame of the outer edge part of the bow part 3. Thickness dimensions (plate thicknesses) of the main body part 4*b*1 and the outer circumferential part 4*b*3 are set to be approximately the same, and the main body part 4*b*1 and the outer circumferential part 4*b*3 are vertically connected by the bent part 4*b*2. Accordingly, the upper surface of the outer circumferential part 4*b*3 is positioned lower than the upper surface of the main body part 4*b*1 and the lower surface of the outer circumferential part 4*b*3 is also positioned lower than the lower surface of the main body part 4*b*1.

The edge sensor 7*b* is attached to the upper surface of the outer circumferential part 4*b*3 using a double-sided tape and the cover bow part 5*b* covers the frame bow part 4*b* in a state in which a space S in which the edge sensor 7*b* can be accommodated is formed. Meanwhile, the space S formed between the upper surface of the outer circumferential part 4*b*3 and the lower surface of the cover bow part 5*b* in a state before a stroke (the state of (a) of FIG. 4) is simply represented as "space S" in the following description.

The cover bow part 5*b* includes an upper cover part 5*b*1 that covers the upper surface of the frame bow part 4*b* and a lower cover part 5*b*2 that is connected to the outer edge of the upper cover part 5*b*1 and covers a range from the outer edge of the frame bow part 4*b* to the edge part of the lower surface of the frame bow part 4*b*. Meanwhile, in a state before a stroke, a space (connected to the space S) is also formed in a region between the lower cover part 5*b*2 and the outer circumferential surface of the outer circumferential part 4*b*3 in addition to the space S.

A protrusion part 5*b*3 in a protrusion shape projecting to the edge sensor 7*b* is formed on the lower surface of the upper cover part 5*b*1 and a gap is formed between the top of the protrusion part 5*b*3 and the edge sensor 7*b*. Accordingly, when the outer edge part of the upper cover part 5*b*1 receives a stroke (refer to (b) of FIG. 4), the protrusion part 5*b*3 presses the edge sensor 7*b* according to elastic deformation (bending) of the upper cover part 5*b*1 toward the space S, and thus the stroke is detected by the edge sensor 7*b*.

Since the gap is formed between the front end face of the protrusion part 5*b*3 and the edge sensor 7*b* in a state before a stroke, the protrusion part 5*b*3 can be restrained from pressing the edge sensor 7*b* when a part other than the cover bow part 5*b*, for example, the bell part 2 (refer to FIG. 2) is struck. Accordingly, when a part other than the outer edge of the cover bow part 5*b* is struck, erroneous detection of the stroke by the edge sensor 7*b* can be curbed.

Although the cover bow part 5*b* is configured such that the protrusion part 5*b*3 presses the edge sensor 7*b* according to elastic deformation of the upper cover part 5*b*1 at the time of a stroke, as described above, the lower cover part 5*b*2 is connected to the outer edge of the upper cover part 5*b*1. Accordingly, when the lower cover part 5*b*2 is elastically deformed along with elastic deformation of the upper cover part 5b1 (refer to (b) of FIG. 4), a configuration in which the lower cover part 5b2 is easily elastically deformed even when a stroke is weak is employed in the present embodiment. This configuration will be described below.

A joint part 5b4 projecting to the lower surface of the main body part 4b1 of the frame bow part 4b is formed from the inner edge (the right end of (a) of FIG. 4) of the lower cover part 5b2. The joint part 5b4 is bonded to the inner circumferential surface of the bent part 4b2 of the frame bow part 4b and the lower surface of the main body part 4b1 by means of an adhesive. On the other hand, the upper surface of the lower cover part 5b2 is not bonded to the lower surfaces of the bent part 4b2 and the outer circumferential part 4b3 on a circumferential side (the left side of (a) of FIG. 4) outside the joint region R1 of the joint part 5b4 and the frame bow part 4b (hereinafter referred to as simply "joint region R1"). In addition, the lower surfaces of the bent part 4b2 and the outer circumferential part 4b3 and the upper surface of the lower cover part 5b2 are flattened in a region where bonding is not present. Accordingly, a connection that obstructs deformation toward the inner circumferential side (inside in the radial direction) of the lower cover part 5b2 is not formed between the lower surface of the frame bow part 4b and the upper surface of the lower cover part 5b2.

That is, in a state in which deformation toward the inner circumferential side of the lower cover part 5b2 or downward is permitted, the inner edge side of the lower cover part 5b2 is bonded to the lower surface of the frame bow part 4b through the joint part 5b4 on the side of the lower surface of the frame bow part 4b. Accordingly, restriction of elastic deformation of the lower cover part 5b2 by the frame bow part 4b can be curbed, and thus the lower cover part 5b2 can be easily elastically deformed when the outer edge part of the upper cover part 5b1 is struck.

In addition, since the joint region R1 is positioned on a circumferential side (the right side of (a) of FIG. 4) inside the space S (edge sensor 7b), a region where the lower surface of the frame bow part 4b is not bonded to the lower cover part 5b2 can be formed to be long in the radial direction. Accordingly, a movable range of the lower cover part 5b2 can be extended, and thus the lower cover part 5b2 can be easily elastically deformed.

Further, the thickness dimension (thickness) of the lower cover part 5b2 is less than the thickness dimension of the upper cover part 5b1. More specifically, the thickness dimension L1 (refer to (a) of FIG. 4) of the lower cover part 5b2 in a region facing the lower surface of the outer circumferential part 4b3 (and the bent part 4b2) of the frame bow part 4b is less than the thickness dimension L2 of the upper cover part 5b1 in a region facing the upper surface (space S) of the outer circumferential part 4b3. Accordingly, the lower cover part 5b2 can be easily elastically deformed when the outer edge part of the upper cover part 5b1 is struck.

It is possible to securely press the protrusion part 5b3 to the edge sensor 7b even when a stroke applied to the upper cover part 5b1 is weak by causing the lower cover part 5b2 to be easily elastically deformed as described above. Accordingly, it is possible to improve stroke detection accuracy.

Meanwhile, the thickness dimension L1 of the lower cover part 5b2 is approximately constant over a range from the inner circumferential side to the outer circumferential side in the region facing the lower surface of the outer circumferential part 4b3 (and the bent part 4b2) in the present embodiment. According to this configuration, the lower cover part 5b2 can be elastically deformed in such a manner that the entire lower cover part 5b2 is bent, but the present disclosure is not necessarily limited thereto. For example, the lower cover part 5b2 may be configured such that the thickness dimension of a part thereof is small in the region facing the lower surfaces of the outer circumferential part 4b3 and the bent part 4b2 and the thin part is deformed such that it is bent. Accordingly, it is possible to cause the lower cover part 5b2 to be elastically deformed more easily.

Here, although a concave part (level difference) is formed at the outer edge part of the upper surface of the frame bow part 4b and the space S is formed according to the concave part in the present embodiment, the space S may also be formed by providing a concave part (level difference) on the lower surface of the upper cover part 5b1 as in the conventional technique (for example, Japanese Patent Laid-Open No. 2009-145559).

However, when a concave part is provided on the side of the upper cover part 5b1, the thickness of the upper cover part 5b1 decreases and thus the upper cover part 5b1 is deformed in such a manner that a part thereof is bent when struck so that the protrusion part 5b3 may not be appropriately pressed to the edge sensor 7b. To solve this problem, when the thickness of the upper cover part 5b1 is increased in a region facing the space S, it is necessary to also increase the thickness of the upper cover part 5b1 on a circumferential side inside the space S. That is, in the configuration in which the concave part is provided on the side of the upper cover part 5b1 to form the space S, it is difficult to achieve both reduction of the thickness of the cover bow part 5b and detection of a stroke applied to the upper cover part 5b1 with high accuracy.

On the contrary, in the present embodiment, the frame bow part 4b includes the bent part 4b2 bent downward from the outer edge of the main body part 4b1, and the outer circumferential part 4b3 projecting from the lower end side of the bent part 4b2 to the outer circumferential side, having the upper surface on which the edge sensor 7b is disposed. Accordingly, a concave part can be formed according to a level difference between the bent part 4b2 and the outer circumferential part 4b3 and the space S can be formed using the concave part. Therefore, it is possible to secure the thickness of the upper cover part 5b1 in the region facing the space S while reducing the thickness of the entire cover bow part 5b as compared to a case in which a concave part is provided on the side of the upper cover part 5b1 to form the space S. That is, it is possible to achieve both reduction of the thickness of the cover bow part 5b and detection of a stroke applied to the upper cover part 5b1 with high accuracy. Furthermore, since the level difference is formed in the cover bow part 5b according to the bent part 4b2 and the outer circumferential part 4b3, the rigidity of the outer edge part of the cover bow part 5b can be improved.

Furthermore, since the joint part 5b4 projecting to the lower surface of the main body part 4b1 is formed on the inner edge side of the lower cover part 5b2, the joint part 5b4 can be hooked using the level difference formed according to the bent part 4b2 and the outer circumferential part 4b3. Accordingly, displacement toward the outer circumferential side of the lower cover part 5b2 can be restricted by hooking of the inner circumferential surface of the bent part 4b2 and the joint part 5b4, and thus application of a force toward the outer circumferential side to the joint region R1 can be suppressed. Therefore, separation of attachment in the joint region R1 can be suppressed.

On the other hand, when the upper cover part 5b1 is struck, a force toward the inner circumferential side is applied to the joint region R1. However, in the present embodiment, a configuration which can reduce the force is provided. That is, the thickness dimension L1 of the lower cover part 5b2 in the region facing the lower surface of the outer circumferential part 4b3 (and the bent part 4b2) is less than the thickness dimension L3 of the joint part 5b4. Accordingly, only the lower cover part 5b2 can be easily elastically deformed when the upper cover part 5b1 is struck, and thus application of the force toward the inner circumferential side to the joint region R1 at the time of a stroke can be suppressed. Therefore, separation of adhesion in the joint region R1 can be suppressed.

In addition, the joint region R1 is a connection part of the inner circumferential surface of the bent part 4b2 and the lower surface of the main body part 4b1 and is positioned above the lower end of the inner circumferential surface of the bent part 4b2. Accordingly, outflow of the adhesive for bonding the joint part 5b4 to the frame bow part 4b between the lower surface of the outer circumferential part 4b3 and the upper surface of the lower cover part 5b2 can be suppressed. Therefore, narrowing of a movable range of the lower cover part 5b2 can be curbed. Furthermore, since a concave part 5b5 recessed downward is formed on the upper surface of the joint part 5b4 on a circumferential side inside the joint region R1, outflow of the adhesive to the inner circumferential side of the joint part 5b4 can be suppressed. Accordingly, it is possible to curb deterioration of adhesion between the frame bow part 4b and the joint part 5b4 and improve the appearance of the electronic cymbal 1.

Here, to detect a stroke applied to the upper cover part 5b1 with high accuracy as described above, a predetermined thickness is necessary for the upper cover part 5b1 in the region facing the space S. This is because the entire upper cover part 5b1 needs to be deformed such that it is bent when struck (refer to (b) of FIG. 4). In other words, in the case of a configuration in which a part of the upper cover part 5b1 is formed to be thin in the region facing the space S as in the conventional technique (for example, Japanese Patent Laid-Open No. 2009-145559), the thin part may be deformed such that it is bent when struck. Accordingly, a stroke applied to the upper cover part 5b1 may not be detected with high accuracy.

On the contrary, in the present embodiment, the thickness dimension L2 of the upper cover part 5b1 is approximately constant over a range from the inner circumferential side to the outer circumferential side in the region facing the upper surface of the outer circumferential part 4b3 of the frame bow part 4b (the concave part formed according to the level difference between the bent part 4b2 and the outer circumferential part 4b3). Accordingly, the upper cover part 5b1 can be easily deformed such that the entire upper cover part 5b1 is bent when struck, and thus the protrusion part 5b3 can be securely pressed to the edge sensor 7b according to deformation of the upper cover part 5b1. Therefore, a stroke applied to the upper cover part 5b1 can be detected with high accuracy.

In addition, the upper cover part 5b1 is bonded to the upper surface of the frame bow part 4b (the main body part 4b1) on a circumferential side inside the outer edge of the upper surface of the bent part 4b2. That is, the upper cover part 5b1 is not bonded to the upper surface of the frame bow part 4b (the main body part 4b1 and the bent part 4b2) on a circumferential side outside the joint region R2 of the upper cover part 5b1 and the upper surface of the frame bow part 4b. Accordingly, the upper cover part 5b1 (the portion that is not bonded to the upper surface of the frame bow part 4b) extends to the outer circumferential side and thus is easily deformed when struck.

Furthermore, the thickness dimension L2 of the upper cover part 5b1 is approximately constant over a range from the region that is not bonded to the upper surface of the frame bow part 4b to the region facing the upper surface of the outer circumferential part 4b3. Accordingly, the upper cover part 5b1 is easily deformed such that it extends to the outer circumferential side as compared to a case in which the thickness dimension of the upper cover part 5b1 is partially thick, for example. By causing the upper cover part 5b1 to be easily elastically deformed toward the outer circumferential side in this manner, it is possible to securely press the protrusion part 5b3 to the edge sensor 7b even when a stroke applied to the upper cover part 5b1 is weak. Accordingly, it is possible to improve detection accuracy for a weak stroke.

In addition, the thickness dimension L2 of the upper cover part 5b1 is approximately constant and the upper surface of the outer circumferential part 4b3 is parallel to the lower surface of the upper cover part 5b1 (region where the protrusion part 5b3 is not formed) in the region facing the upper surface of the outer circumferential part 4b3. Accordingly, it is possible to cause the entire upper cover part 5b1 to be bent and easily deformed when struck while minimizing the thickness dimension from the upper surface of the outer circumferential part 4b3 to the upper surface of the upper cover part 5b1.

Next, the case 8 provided in the frame 4 and a fitting structure of the case 8 will be described with reference to FIGS. 5 and 6. (a) of FIG. 5 is a bottom view of the electronic cymbal 1 and (b) of FIG. 5 is a bottom view of the electronic cymbal 1 when the case 8 has been removed. As shown in (a) of FIG. 5, the case 8 is provided on the bottom surface of the frame 4.

As shown in (b) of FIG. 5, a frame-side setting part 4c into which the case 8 is fitted is formed on the bottom surface of the frame 4 on a side outside the frame bell part 4a. In the present embodiment, the frame-side setting part 4c is formed at six places in a circumferential direction with respect to the outer side of the frame bell part 4a. A structure of the frame-side setting part 4c and a fitting structure of the case 8 with respect to the frame-side setting part 4c will be described with reference to FIG. 6.

FIG. 6 is a cross-sectional view of the electronic cymbal 1 taken along line VI-VI of FIG. 1. As shown in FIG. 6, the frame-side setting part 4c includes a supporting part 4c1 and a protrusion receiving part 4c2. The supporting part 4c1 is a part provided on the bottom surface of the frame 4 and formed in an L shape in a cross-sectional view. An L-shaped opening part in the supporting part 4c1 is formed such that it faces the outer circumferential side of the frame 4.

The protrusion receiving part 4c2 is a hole provided to adjoin the outer circumferential side of the supporting part 4c1 and formed to penetrate the frame 4. The end of the outer circumferential side of the protrusion receiving part 4c2 in the frame 4 is formed outside the end of the outer circumferential side of the supporting part 4c1 in the frame 4.

A hooking part 8b that is a part for causing the frame-side setting part 4c to be fitted thereto is formed at a case outer wall 8a in a wall shape which forms the outer circumferential side of the case 8. The hooking part 8b is provided at the upper part of the side of the inner circumferential side of the case outer wall 8a and formed in an arrow shape in a cross-sectional view. Specifically, a tapering tip 8b1 is formed on the inner circumferential side of the hooking part

8*b* (the right side of FIG. 6), and a projection 8*b*2 projecting upward (to the side of the frame 4) is formed on a circumferential side (the left side of FIG. 6) outside the tip 8*b*1. In addition, the length of the bottom surface of the hooking part 8*b* and the upper surface of the projection 8*b*2 is greater than the length of the upper surface of the supporting part 4*c*1 of the frame-side setting part 4*c* and the bottom surface of the frame 4.

Fitting of the frame-side setting part 4*c* and the hooking part 8*b* will be described. First, the hooking part 8*b* is inserted between the supporting part 4*c*1 and the protrusion receiving part 4*c*2 of the frame-side setting part 4*c*. At this time, since the tip 8*b*1 of the hooking part 8*b* is formed such that it is tapered, the hooking part 8*b* can be smoothly inserted between the supporting part 4*c*1 and the protrusion receiving part 4*c*2. Here, although the length of the bottom surface of the hooking part 8*b* and the part projecting upward is greater than the length of the bottom surfaces of the supporting part 4*c*1 and the frame 4, the projection 8*b*2 made of synthetic rubber is elastically deformed between the upper surface of the supporting part 4*c*1 and the bottom surface of the frame 4 when the hooking part 8*b* is inserted between the supporting part 4*c*1 and the protrusion receiving part 4*c*2, and thus the hooking part 8*b* can be inserted between the supporting part 4*c*1 and the protrusion receiving part 4*c*2.

Furthermore, when the tip 8*b*1 is inserted until it comes into contact with the supporting part 4*c*1, the projection 8*b*2 is fitted into the protrusion receiving part 4*c*2. Accordingly, the hooking part 8*b* is fitted into the frame-side setting part 4*c*. When the hooking part 8*b* is fitted into the frame-side setting part 4*c* in this manner, movement of the case 8 in the inner circumferential direction can be restricted using the tip 8*b*1 in contact with the supporting part 4*c*1. In addition, downward movement of the case 8 can be restricted by the bottom surface of the hooking part 8*b* in contact with the upper surface of the supporting part 4*c*1. Accordingly, separation of the hooking part 8*b* from the frame-side setting part 4*c* can be suppressed, and thus separation of the case outer wall 8*a* from the frame 4 can be suppressed.

Next, a fitting structure into the frame bell part 4*a* on the inner circumferential side of the case 8 will be described. As shown in FIG. 6, an enclosing part 8*d* that encloses the inner circumferential side of the frame bell part 4*a* is formed at the upper part of a case inner wall 8*c* in a wall shape which forms the inner circumferential side of the case 8. The enclosing part 8*d* is formed such that it comes into contact with the upper surface, the bottom surface and the side on the inner circumferential side of the frame bell part 4*a* when the enclosing part 8*d* is hooked on the inner circumferential side of the frame bell part 4*a*. In addition, the enclosing part 8*d* is formed at four places at the upper part of the case inner wall 8*c*.

By enclosing the inner circumferential side of the frame bell part 4*a* with the enclosing part 8*d*, the case inner wall 8*c* is fitted into the frame bell part 4*a*. Since the side of the inner circumferential side of the frame bell part 4*a* comes into contact with the enclosing part 8*d*, movement of the case 8 in the outer circumferential direction thereof can be restricted. In addition, since the upper surface and the bottom surface of the frame bell part 4*a* on the inner circumferential side thereof also come into contact with the enclosing part 8*d*, movement of the case 8 in the vertical direction can be restricted. Accordingly, since separation of the enclosing part 8*d* from the inner circumferential side of the frame 4 can be suppressed, separation of the case inner wall 8*c* from the frame 4 can be suppressed.

However, the enclosing part 8*d* for fitting the inner circumferential side of the case 8 and the engagement part 5*a*3 for engaging the cover 5 are provided at four places on the inner circumferential side of the frame 4. The enclosing part 8*d* and the engagement part 5*a*3 are formed such that they are alternately provided on the inner circumferential side in the circumferential direction of the frame 4 such that the enclosing part 8*d* and the engagement part 5*a*3 do not interfere on the inner circumferential side of the frame 4.

As described above, the case 8 is attached to the frame 4 in such a manner that the hooking part 8*b* on the outer circumferential side of the case 8 is fitted into the frame-side setting part 4*c* and the enclosing part 8*d* is fitted into the inner circumferential side of the frame 4. It is not necessary to form screw holes in the frame 4 and screw the case 8 and the frame 4. Accordingly, concentration of stress on a specific position of the frame 4 due to screwing can be suppressed, and thus stroke sensitivity distribution on the frame 4 can become uniform.

In addition, the case 8 is fitted into the frame 4 at two places of the inner circumferential side and the outer circumferential side of the case 8. Here, movement of the case 8 in the inner circumferential direction is restricted by the frame-side setting part 4*c* and the hooking part 8*b* and movement of the case 8 in the outer circumferential direction is restricted by the enclosing part 8*d*. Accordingly, it is possible to mount the case 8 onto the case 4 securely and firmly because movement of the case 8 in the inner circumferential direction and the outer circumferential direction can be restricted.

A structure that restricts movement of the case 8 in the circumferential direction and the vertical direction is further provided in the case 8 and the frame 4 in addition to the frame-side setting part 4*c*, the hooking part 8*b* and the enclosing part 8*d*. Specifically, a convex-shaped supporting pillar 8*e* is provided upward from the bottom surface of the case 8. The supporting pillar 8*e* is formed on a circumferential side (the right side of FIG. 6) inside the case outer wall 8*a*, which is a circumferential side inside the supporting part 4*c*1 of the case 4 when the case 8 is mounted onto the frame 4. In addition, the length of the supporting pillar 8*e* in the vertical direction is set to a degree to which a gap is formed between the upper surface of the supporting pillar 8*e* and the bottom surface of the frame 4 when the case 8 is mounted onto the frame 4.

On the other hand, a convex-shaped restriction part 4*d* is provided on the bottom surface of the frame 4 on a circumferential side inside the supporting pillar 8*e* when the case 8 is mounted onto the frame 4. Further, the supporting pillar 8*e* of the case 8 is formed at the whole circumference in the circumferential direction of the case 8 and the restriction part 4*d* is also formed at the whole circumference in the circumferential direction of the frame 4.

When the case 8 has moved in the inner circumferential direction, the supporting pillar 8*e* comes into contact with the restriction part 4*d* so that movement in the inner circumferential direction is restricted. On the other hand, when the case 8 has largely moved in the outer circumferential direction, the supporting pillar 8*e* comes into contact with the supporting part 4*c*1 so that movement in the outer circumferential direction is restricted. Accordingly, it is possible to appropriately maintain fitting of the frame 4 and the case 8 because displacement of the frame 4 and the case 8 in the radial direction can be suppressed.

In addition, when the case 8 is mounted onto the frame 4, a gap is formed between the upper surface of the supporting pillar 8*e* and the bottom surface of the frame 4. Accordingly, the number of contacts (i.e., constraint points) of the frame 4 and the case 8 can be reduced, and thus attenuation of vibration of the frame 4 due to absorption of vibration of the frame 4 according to a stroke into the case 8 can be curbed. On the other hand, when external force is applied from the bottom surface of the case 8, a gap between the supporting pillar 8*e* and the frame 4 is eliminated so that the upper surface of the supporting pillar 8*e* comes into contact with the bottom surface of the frame 4, and thus the bottom surface of the case 8 can be supported by the supporting pillar 8*e*. Accordingly, deformation of the case 8 can be suppressed.

In addition, the supporting part 4*c*1 is a part engaged with the hooking part 8*b* and a part in contact with the outer circumferential side of the supporting pillar 8*e*. Accordingly, since a part engaged with the hooking part 8*b* and a part in contact with the outer circumferential side of the restriction part 4*d* need not to be separately formed when the single supporting part 4*c*1 is formed, it is possible to reduce the manufacturing cost of the frame 4 and form the bottom surface of the frame 4 in a simpler shape, resulting in improvement of the performance of vibration propagation to the frame 4 according to a stroke.

Next, the shape of the case 8 will be described with reference to FIG. 7. (a) of FIG. 7 is a top view of the case 8 and (b) of FIG. 7 is a cross-sectional view of the case 8 taken along line VIIb-VIIb. As shown in FIG. 7, a pillar setting part 8*f*, a case bottom wall 8*g*, and a protection part 8*h* are provided in the case 8 in addition to the aforementioned case outer wall 8*a*, the hooking part 8*b*, the case inner wall 8*c*, the enclosing part 8*d*, and the supporting pillar 8*e*.

The pillar setting part 8*f* is formed between the case inner wall 8*c* and the case inner wall 8*c* at the center of the bottom surface of the case 8 in a top view and sets a pillar (not shown) that supports the electronic cymbal 1. The case bottom wall 8*g* is a part in a wall shape which forms the bottom surface of the case 8. The protection part 8*h* is formed on the case bottom wall 8*g* and is a section for protecting electronic parts (not shown) provided on the bottom surface of the frame 4.

A thick part 8*g*1 formed in thick thickness of the case bottom wall 8*g* is formed at a position opposite the protection part 8*h* based on the pillar setting part 8*f* in the case bottom wall 8*g*. Since electronic parts are provided in the frame 4, weight balance of the frame 4 deviates to the electronic parts due to the weight of the electronic parts. Accordingly, when the pillar is set in the pillar setting part 8*f*, the electronic cymbal 1 inclines to the side on which the electronic parts are provided.

Therefore, the weight of the thick part 8*g*1 in the case 8 is increased by forming the thick part 8*g*1 with thick thickness in the case bottom wall 8*g* at the position opposite the protection part 8*h* based on the pillar setting part 8*f*. Accordingly, deviation of weight balance due to the electronic parts provided in the frame 4 is corrected according to the weight of the thick part 8*g*1, and thus inclination of the electronic cymbal 1 can be suppressed when the pillar has been set in the pillar setting part 8*f*. Furthermore, it is possible to suppress inclination of the electronic cymbal 1 without setting an additional "weight" to the case 8 and the like by providing the thick part 8*g*1.

Although description has been given on the basis of the above-described embodiment, various improvements and modifications can be easily conjectured.

In the above-described embodiment, the bell part sensor 6 is divided into two sensors of the inner circumferential sensor 6*a* and the outer circumferential sensor 6*b*. However, the present disclosure is not limited to division of the bell part sensor 6 into two sensors, and the bell part sensor 6 may be divided into two or more on the basis of the size of the bell part 2. For example, the bell part sensor may be divided into three sensors by providing an outermost circumferential sensor 6*d* in addition to the inner circumferential sensor 6*a* and the outer circumferential sensor 6*b* like a bell part sensor 60 of (a) of FIG. 8 and a bell part sensor 61 of (b) of FIG. 8.

In this case, the connecting part 6*c* may be provided at in-phase positions between the inner circumferential sensor 6*a* and the outer circumferential sensor 6*b* and between the outer circumferential sensor 6*b* and the outermost circumferential sensor 6*d* as in the bell part sensor 60 of (a) of FIG. 8 or the connecting part 6*c* may be provided at arbitrary positions between the inner circumferential sensor 6*a* and the outer circumferential sensor 6*b* and between the outer circumferential sensor 6*b* and the outermost circumferential sensor 6*d* as in the bell part sensor 61 of (b) of FIG. 8. Further, four or more connecting parts 6*c* may be provided between the inner circumferential sensor 6*a* and the outer circumferential sensor 6*b* and between the outer circumferential sensor 6*b* and the outermost circumferential sensor 6*d* as in the bell part sensor 61.

In the above-described embodiment, the bell part sensor 6 is formed in an arc shape (C shape) with a part cut away in a top view. However, the shape of the bell part sensor 6 is not necessarily limited thereto and the bell part sensor 6 may be formed such that it is continues in the circumferential direction in a top view.

In the above-described embodiment, the side of the frame bell part 4*a* is formed in a conical shape such that the cross section thereof in the radial direction is formed in a straight shape. However, the cross-sectional shape of the frame bell part 4*a* in the radial direction is not limited to a straight shape and an arbitrary shape may be used. For example, a depression 40*a*1 may be formed between adjoining bell part sensors 6 as shown in a frame bell part 40*a* of (c) of FIG. 8 or a frame bell part 41*a* may be formed in a hemispherical shape as shown in a frame bell part 41*a* of (d) of FIG. 8. In both cases, it is desirable to form the cross-sectional shapes in a radial direction of at least portions of the frame bell parts 40*a* and 41*a* at which the bell part sensor 6 is provided into a straight shape such that the bell part sensor 6 provided on the frame bell parts 40*a* and 41*a* can face the protrusion part 5*a*1 of the cover 5.

In the above-described embodiment, the recess 5*a*2 is provided at a position on a circumferential side inside the protrusion part 5*a*1 on the inner circumferential side in the cover bell part 5*a*. However, the present disclosure is not necessarily limited thereto and, for example, a U-shaped recess 50*a*2 in a cross-sectional view may be provided at a position on a circumferential side outside the protrusion part 5*a*1 on the outer circumferential side in the cover bell part 5*a* in addition to the recess 5*a*2 as in a cover bell part 50*a* of (c) of FIG. 8. Further, the recess 5*a*2 may be omitted and only the recess 50*a*2 may be provided, or both the recess 5*a*2 and the recess 50*a*2 may be omitted. In addition, the shapes of the recess 5*a*2 and the recess 50*a*2 are not limited to a U shape in a cross-sectional view and a rectangular shape or a V shape may be used.

In the above-described embodiment, the engagement part 5*a*3 is formed such that it comes into contact with the upper surface, the bottom surface and the side of the frame bell part 4*a* when the engagement part 5*a*3 has hooked the inner circumferential side of the frame bell part 4*a*. However, the present disclosure is not necessarily limited thereto and, for example, the portion of the engagement part 51*a*3 which comes into contact with the bottom surface of the frame bell part 4*a* may be omitted and the engagement part 51*a*3 may be formed such that it comes into contact with the upper surface and the side of the frame bell part 4*a* like an engagement part 51*a*3 of a cover bell part 51*a* of (a) of FIG. 9.

In the above-described embodiment, the enclosing part 8*d* is formed such that it comes into contact with the upper surface, the bottom surface and the side of the frame bell part 4*a* when the enclosing part 8*d* has hooked the inner circumferential side of the frame bell part 4*a*. However, the present disclosure is not necessarily limited thereto and, for example, the portion of the enclosing part 8*d* which comes into contact with the bottom surface of the frame bell part 4*a* may be omitted and the enclosing part 8*d* may be formed such that it engages with the upper surface and the side of the frame bell part 4*a* like an enclosing part 80*d* of a case 80 of (b) of FIG. 9.

In the above-described embodiment, the supporting part 4*c*1 of the frame 4 is formed in an L shape, the opening part thereof is formed such that it faces the outer circumferential side of the frame 4, and the tip 8*b*1 of the hooking part 8*b* of the case 8 is formed such that it faces the inner circumferential side of the case 8. However, the present disclosure is not necessarily limited. For example, like a supporting part 42*c*1 of a frame 42 of (c) of FIG. 9, the opening part of the supporting part 42*c*1 may be formed such that it faces the inner circumferential side of the frame 4 and a tip 81*b*1 of a hooking part 81*b* of a case 81 may be formed such that it faces the outer circumferential side of the case 8.

In the above-described embodiment, the hooking part 8*b* is provided at the upper part of the side of the inner circumferential side of the case outer wall 8*a*. However, the position at which the hooking part 8*b* is provided is not necessarily limited thereto and, for example, a hooking part 82*b* may be provided on the upper surface of the case outer wall 8*a* as in a case 82 of (d) of FIG. 9. Here, the hooking part 82*b* may be formed in an upwardly convex shape as shown in (d) of FIG. 9, a protrusion receiving part 43*c*2 of a frame 43 may be formed in a depression shape, and the hooking part 82*b* may be fitted into the protrusion receiving part 43*c*2. Accordingly, a downward load of the frame 43 can be supported according to fitting of the hooking part 82*b* and the protrusion receiving part 43*c*2, and thus the supporting part 4*c*1 can be omitted from the frame 43.

Further, when the supporting part 4*c*1 is omitted from the frame 43, a supporting pillar 82*e* may be additionally provided on the outer circumferential side of the restriction part 4*d* in the case 82. Accordingly, it is possible to restrict movement of the case 8 in the outer circumferential direction, which is not restricted on the outer circumferential side of the case 82, using the restriction part 4*d* and the supporting pillar 82*e* by omitting the supporting part 4*c*1. Meanwhile, the supporting pillar 82*e* may be provided in the case 8 in the above-described embodiment, the case 80 of (b) of FIG. 9, and the case 81 of (c) of FIG. 9.

In the above-described embodiment, an electronic cymbal is illustrated as an example of an electronic percussion instrument. However, the electronic percussion instrument is not necessarily limited thereto and the technical spirit (for example, a configuration in which the thickness of the cover facing the sensor is approximately constant) of the above-described embodiment may be applied to electronic percussion instruments that imitates other instruments such as a cajon and a woodblock. Accordingly, although a disk-shaped frame is described as an example of a main body member that is a frame of an electronic percussion instrument in the above-described embodiment, for example, the present disclosure is not necessarily limited thereto. For example, the shape of the main body member in a top view may be formed into a rectangular shape, a polygonal shape, or a combination of a curved shape and a straight shape. In addition, a configuration in which a thickness dimension (dimension in the vertical direction) of the main body member is greater than the cover 5 (for example, the main body member is formed in a box shape) may be employed.

In the above-described embodiment, the frame 4 is formed of reinforced plastic. However, the present disclosure is not limited thereto, and the frame 4 may be formed of other resin materials or a metal. In addition, although the cover 5 and the case 8 are formed of synthetic rubber in the above-described embodiment, the material of the cover 5 and the case 8 is not limited thereto and they may be formed of other resin materials such as silicone.

In the above-described embodiment, the bell part sensor 6 and the edge part sensor 7 are attached to the frame bell part 4*a* and the frame bow part 4*b* using a double-sided tape. In addition, the cover 5 is attached to the upper surface of the frame 4 using a double-sided tape and the cover 5 (joint part 5*b*4) may be attached to the lower surface of the frame 4 using an adhesive. However, the present disclosure is not necessarily limited thereto and the bell part sensor 6 and the edge part sensor 7 may be attached to the frame bell part 4*a* and the frame bow part 4*b* using an adhesive. In addition, the cover 5 may be attached to the upper surface of the frame 4 using an adhesive and the cover 5 (joint part 5*b*4) is attached to the lower surface of the frame 4 using a double-sided tape. That is, a method for bonding each sensor and the cover 5 to the frame 4 is not limited to adhesion and known bonding methods (e.g., fusing the cover 5 to the frame 4, and the like) that can fix each sensor and the cover 5 to the framed 4 can be applied.

In the above-described embodiment, a case in which the lower cover part 5*b*2 is not bonded to the lower surfaces of the bent part 4*b*2 and the outer circumferential part 4*b*3 of the frame bow part 4*b* and the lower surfaces of the bent part 4*b*2 and the outer circumferential part 4*b*3 and the upper surface of the lower cover part 5*b*2 are flattened in the non-bonded region is described. However, the present disclosure is not necessarily limited thereto and a configuration in which prominences and depressions are formed on the lower surface of the frame bow part 4*b* and the upper surface of the lower cover part 5*b*2 may be employed as long as the prominences and depressions do not hinder deformation of the lower cover part 5*b*2 toward the inner circumferential side. As an example of such a configuration, for example, a configuration in which depressions are formed only on the lower surface of the frame bow part 4*b* (the upper surface of the lower cover part 5*b*2) or a configuration in which micro prominences and depressions are formed on the lower surface of the frame bow part 4*b* and the upper surface of the lower cover part 5*b*2 to a degree to which the lower surface of the frame bow part 4*b* and the upper surface of the lower cover part 5*b*2 are not caught in each other are exemplified.

In the above-described embodiment, a case in which the bent part 4*b*2 and the outer circumferential part 4*b*3 are formed at the outer edge of the main body part 4*b*1 of the frame bow part 4*b* is described. However, the present disclosure is not limited thereto and the frame bow part 4*b* may be configured as a frame having no level difference by omitting the bent part 4*b*2 and the outer circumferential part 4*b*3. In this case, the space S may be formed by providing a concave part on the outer edge side of the lower surface of the upper cover part 5b1, the edge sensor 7b may be accommodated in the space S, the joint part 5b4 at the inner edge part of the lower cover part 5b2 may be omitted, and the lower cover part 5b2 may be bonded to the lower surface of the frame bow part 4b.

In the above-described embodiment, a case in which the joint region R1 is positioned to be circumferentially further inward than the space S is described. However, the present disclosure is not necessarily limited thereto and a configuration in which the joint region R1 is positioned on a circumferential side outside the space S may be employed. That is, a configuration in which the lower cover part 5b2 is bonded to the lower surfaces of the bent part 4b2 and the outer circumferential part 4b3 of the frame bow part 4b may be employed if the lower cover part 5b2 is not bonded to the outer edge side of the lower surface of the frame bow part 4b.

In the above-described embodiment, a case in which the joint part 5b4 is bonded to the range from the inner circumferential surface of the bent part 4b2 of the frame bow part 4b to the lower surface of the main body part 4b1 is described. However, the present disclosure is not necessarily limited thereto and a configuration in which the joint part 5b4 is bonded to only the inner circumferential surface of the bent part 4b2 or a configuration in which the joint part 5b4 is bonded to only the lower surface of the main body part 4b1 may be employed.

In the above-described embodiment, a case in which the thickness dimension L1 of the lower cover part 5b2 is less than the thickness dimension L2 of the upper cover part 5b1 is described. However, the present disclosure is not necessarily limited thereto and a configuration in which the thickness dimension L1 of the lower cover part 5b2 is the same as the thickness dimension L2 of the upper cover part 5b1 may be employed or a configuration in which the thickness dimension L1 of the lower cover part 5b2 is greater than the thickness dimension L2 of the upper cover part 5b1 may be employed.

In the above-described embodiment, a case in which the thickness dimension L2 of the upper cover part 5b1 is approximately constant in the region facing the upper surface of the outer circumferential part 4b3 of the frame bow part 4b is described. However, the present disclosure is not necessarily limited thereto and a configuration in which the thickness dimension of the upper cover part 5b1 may be reduced in a part of the upper cover part 5b1. An electronic cymbal 1A of an embodiment will be described with reference to FIG. 10. In this case, the thickness dimension of the upper cover part 5b1 is reduced in a part of the upper cover part 5b1 in a region facing the space S (the edge sensor 7b) as compared to the embodiment of FIG. 4. Particularly, it is desirable to decrease the thickness dimension of the upper cover part 5b1 in a part of the upper cover part 5b1 on a circumferential side inside the space S (the edge sensor 7b) to form a thin part 5b1*a*. For example, if the thickness dimension of the upper cover part 5b1 is decreased in a part of the upper cover part 5b1 in a region where the upper cover part 5b1 is not bonded to the upper surface of the frame bow part 4b, such a thin part (i.e., the thin part 5b1*a*) stretches and thus is easily elastically deformed. Accordingly, the thin part is bent according to a stroke of a stick in the lateral direction so that the edge sensor can more easily operate.

In the above-described embodiment, a case in which the upper cover part 5b1 is bonded to the upper surface of the frame bow part 4b (the main body part 4b1) on a circumferential side inside the outer edge (space S) of the upper surface of the bent part 4b2 is described. However, the present disclosure is not necessarily limited thereto and a configuration in which the upper cover part 5b1 is bonded to the entire upper surface of the frame bow part 4b may be employed.

In the above-described embodiment, a case in which the upper surface of the outer circumferential part 4b3 is parallel to the lower surface of the upper cover part 5b1 (the region where the protrusion part 5b3 is not formed) is described. However, the present disclosure is not necessarily limited thereto and a configuration in which the upper surface of the outer circumferential part 4b3 is not parallel to the lower surface of the upper cover part 5b1 in a region facing the upper surface of the outer circumferential part 4b3 (the edge sensor 7b) may be employed. In this case, it is desirable to configure the outer circumferential part 4b3 and the upper cover part 5b1 such that a gap between the upper surface of the outer circumferential part 4b3 and the lower surface of the upper cover part 5b1 widens with decreasing distance to the outer circumferential side in such a region. Accordingly, since the upper cover part 5b1 is elastically deformed such that the lower surface of the upper cover part 5b1 becomes approximately parallel to the upper surface of the outer circumferential part 4b3 when struck, the edge sensor 7b can be pressed against the parallel surfaces of the front end surface of the protrusion part 5b3 and the upper surface of the outer circumferential part 4b3. Accordingly, a stroke applied to the upper cover part 5b1 can be appropriately transmitted to the edge sensor 7b.

In the above-described embodiment, a case in which the joint part 5b4 is hooked by the level difference formed by the bent part 4b2 and the outer circumferential part 4b3 is described. However, the present disclosure is not necessarily limited thereto and a configuration in which a concave part is formed on the lower surface of the frame bow part 4b and the joint part 5b4 is fitted into the concave part may be employed. Accordingly, displacement of the joint part 5b4 toward both the outer circumferential side and the inner circumferential side can be suppressed. That is, a concave part and a convex part that can be fitted into each other may be formed on the lower surface of the frame 4 and the upper surface of the cover 5 if the concave part and the convex part are positioned on a circumferential side inside a joint position of the lower surface of the frame bow part 4b and the part (joint part 5b4) on the inner edge side of the lower cover part 5b2.

In the above-described embodiment, a case in which outflow of the adhesive to a more inner circumferential side than the joint part 5b4 is prevented by forming the concave part 5b5 on the upper surface of the joint part 5b4 is described. However, the present disclosure is not necessarily limited thereto and a configuration in which the concave part 5b5 is omitted (or in addition to the concave part 5b5) and a concave part is provided on the lower surface of the frame bow part 4b to prevent outflow of the adhesive may be employed.

The numerical values described in the above-described embodiment are examples and other numerical values may be employed.

What is claimed is:

1. An electronic percussion instrument, comprising:

a disk-shaped frame in which a concave part recessed toward a lower surface side is formed at an outer edge part of an upper surface;

a sensor disposed in the concave part of the frame; and a cover covering the frame in a state in which a space that can receive the sensor is formed, wherein the cover includes a protrusion part formed in a protrusion shape protruding from a lower surface of the cover to the sensor and disposed having a gap between the protrusion part and the sensor, and a thickness dimension of the cover is substantially constant in a region facing the concave part, in which the protrusion part is not formed, wherein the cover includes an upper cover part which covers an upper surface side of the frame and in which the protrusion part is formed, and a lower cover part which is connected to an outer edge of the upper cover part and covers a range from an outer edge of the frame to an outer edge side of a lower surface of the frame, and an inner edge side of the lower cover part is bonded to the lower surface of the frame in a state in which the lower surface of the frame is not bonded to an outer edge side of an upper surface of the lower cover part and deformation of the lower cover part toward an inner circumferential side is permitted on a side of the lower surface of the frame.

2. The electronic percussion instrument according to claim 1, wherein a joint position of the lower cover part and the lower surface of the frame is positioned to be circumferentially further inward than the space.

3. The electronic percussion instrument according to claim 1, configured as an electronic cymbal including a bell part and a bow part, wherein the frame includes a main body part constituting the bow part, a bent part bent downward from an outer edge of the main body part, and an outer circumferential part projecting from a lower end side of the bent part to the outer circumferential side and having the sensor disposed on an upper surface, and the concave part is formed according to a level difference between the bent part and the outer circumferential part.

4. The electronic percussion instrument according to claim 3, wherein the cover includes a joint part projecting from the inner edge side of the lower cover part to a lower surface of the main body part and bonded to at least one of an inner circumferential surface of the bent part and the lower surface of the main body part.

5. The electronic percussion instrument according to claim 4, wherein a thickness dimension of the lower cover part in a region facing a lower surface of the outer circumferential part is less than a thickness dimension of the joint part.

6. The electronic percussion instrument according to claim 3, wherein a thickness dimension of the lower cover part in a region facing a lower surface of the outer circumferential part is less than a thickness dimension of the upper cover part in a region facing an upper surface of the outer circumferential part.

7. The electronic percussion instrument according to claim 3, wherein the upper cover part is bonded to an upper surface of the frame on the inner circumferential side with respect to an outer edge of an upper surface of the bent part.

8. The electronic percussion instrument according to claim 7, wherein a lower surface of the upper cover part is parallel to an upper surface of the outer circumferential part in a region facing the upper surface of the outer circumferential part.

* * * * *